US009506275B2

(12) United States Patent
Kurita et al.

(10) Patent No.: US 9,506,275 B2
(45) Date of Patent: Nov. 29, 2016

(54) LOCK DEVICE

(75) Inventors: Junya Kurita, Toyokawa (JP); Takao Koba, Takahazuka (JP); Takaharu Kiyama, Nara (JP)

(73) Assignee: SHIROKI CORPORATION, Fujisawa-Shi (JP)

( * ) Notice: Subject to any disclaimer, the term of this patent is extended or adjusted under 35 U.S.C. 154(b) by 149 days.

(21) Appl. No.: 14/347,372

(22) PCT Filed: Sep. 4, 2012

(86) PCT No.: PCT/JP2012/072488

§ 371 (c)(1),
(2), (4) Date: Mar. 26, 2014

(87) PCT Pub. No.: WO2013/047112

PCT Pub. Date: Apr. 4, 2013

(65) Prior Publication Data

US 2014/0225382 A1 Aug. 14, 2014

(30) Foreign Application Priority Data

Sep. 27, 2011 (JP) ..... 2011-210761

(51) Int. Cl.
*E05C 3/06* (2006.01)
*E05B 81/74* (2014.01)
(Continued)

(52) U.S. Cl.
CPC ..... *E05B 81/74* (2013.01); *E05B 81/20* (2013.01); *E05B 81/06* (2013.01); *E05B 81/36* (2013.01);
(Continued)

(58) Field of Classification Search
CPC ..... E05B 2047/0065; E05B 17/22; E05B 63/0065; E05B 81/68; Y10T 70/5978
USPC ..... 292/201, 216, DIG. 23
See application file for complete search history.

(56) References Cited

U.S. PATENT DOCUMENTS 6,409,233 B1 * 6/2002 Hanaki ..... E05B 81/20 292/144
8,651,536 B2 2/2014 Kurebayashi et al.

FOREIGN PATENT DOCUMENTS

CN 101109246 A 1/2008
CN 102057119 A 5/2011
(Continued)

OTHER PUBLICATIONS

English Translation Abstract of JP 2009-299313 A published Dec. 24, 2009.
(Continued)

*Primary Examiner* — Mark Williams
(74) *Attorney, Agent, or Firm* — Millen, White, Zelano & Branigan, P.C.

(57) ABSTRACT

A lock device is achieved, which can prevent a battery, for supplying power to a microcomputer of an electronic control unit, from going flat by reducing the consumption power of the microcomputer, said lock device provided with a lock mechanism which holds an opening-and-closing body, for an opening in a vehicle body, an electronic control unit which operates in a microcomputer normal power mode or a microcomputer power-saving mode; and an open-state detector which detects the state of the lock mechanism. The electronic control unit transfers from the microcomputer normal power mode to the microcomputer power-saving mode when the open-state detector detects that the lock mechanism continuously remains at one of the opening state, the half-latched state and the fully-latched state for a predetermined period of time when operating during the microcomputer normal power mode.

11 Claims, 15 Drawing Sheets

(51) Int. Cl.

| | |
|---|---|
| ***E05B 81/20*** | (2014.01) |
| *E05B 47/00* | (2006.01) |
| *E05B 81/06* | (2014.01) |
| *E05B 81/36* | (2014.01) |
| *E05B 81/68* | (2014.01) |
| *E05B 81/64* | (2014.01) |

(52) U.S. Cl.
CPC ..... *E05B 81/64* (2013.01); *E05B 81/68* (2013.01); *E05B 2047/0065* (2013.01); *Y10T 292/1082* (2015.04)

(56) References Cited

FOREIGN PATENT DOCUMENTS

| | | | |
|---|---|---|---|
| JP | 2001-3620 | A | 1/2001 |
| JP | 2007-125934 | A | 5/2007 |
| JP | 2009-292330 | A | 12/2009 |
| JP | 2009-299313 | A | 12/2009 |
| JP | 2011-106187 | A | 6/2011 |

OTHER PUBLICATIONS

Chinese Office Action dated May 20, 2015 issued in corresponding CN 201280046904.7 application (pp. 1-7).

English Translation Abstract of CN 101109246 A published Jan. 23, 2008.

English Translation Abstract of CN 102057119 A published May 11, 2011.

International Search Report issued in corresponding PCT/JP2012/072488 application (p. 1).

English Translation Abstract of JP 2001-003620 published Jan. 9, 2001.

English Translation Abstract of JP 2007-125934 published May 24, 2007.

English Translation Abstract of JP 2009-292330 published Dec. 12, 2009.

English Translation Abstract of JP 2011-106187 published Jun. 2, 2011.

* cited by examiner

Fig. 13

Microcomputer Normal Power Mode

| Switch | Monitoring State via Monitor Microcomputer |
|---|---|
| Ratchet Detection Switch 30 | Monitor at Predetermined Clock Frequency X(Hz) |
| Open-Lever Detection Switch 31 | Monitor at Predetermined Clock Frequency X(Hz) |
| Sector-Gear Detection Switch 33 | Monitor at Predetermined Clock Frequency X(Hz) |
| Open-Operation Switch 33A | Monitor at Predetermined Clock Frequency X(Hz) |

Fig. 14

Microcomputer Power-Saving Mode

| Switch | Monitoring State via Monitor Microcomputer |
|---|---|
| Ratchet Detection Switch 30 | Monitor at Predetermined Clock Frequency X(Hz) |
| Open-Lever Detection Switch 31 | Stop Monitoring at Predetermined Clock Frequency X(Hz), or Monitor at a Clock Frequency x(Hz) that is lower than that of Microcomputer Normal Power Mode |
| Sector-Gear Detection Switch 33 | Stop Monitoring at Predetermined Clock Frequency X(Hz), or Monitor at a Clock Frequency x(Hz) that is lower than that of Microcomputer Normal Power Mode |
| Open-Operation Switch 33A | Monitor at Predetermined Clock Frequency X(Hz) |

LOCK DEVICE

TECHNICAL FIELD

The present invention relates to a lock device for, e.g., a vehicle opening-and-closing body.

BACKGROUND ART

Such a type of lock device, provided with an opening-and-closing body which opens and closes an opening in a vehicle body, a lock mechanism which switches between an open state, a half-latched state and a fully-latched state in accordance with the amount of opening of the opening-and-closing body, and an electronic control unit (ECU) which is operated in a microcomputer normal power mode or a microcomputer power-saving power mode, is known in the art. Various switches for detecting the state of the lock device are connected to the electronic control unit. The electronic control unit is provided with a microcomputer that includes a switch monitor which monitors the ON/OFF state of each switch.

The electronic control unit, in the microcomputer normal power mode, monitors each switch at a predetermined clock frequency via the switch monitor of the microcomputer. Whereas, in the microcomputer power-saving mode, the electronic control unit stops the monitoring of each switch at a predetermined clock frequency via the switch monitor of the microcomputer, or monitors at a clock frequency that is lower than the predetermined clock frequency.

In an electronic control unit of the related art, when the electronic control unit is operated in the microcomputer normal power mode, the microcomputer normal power mode is only transferred to the microcomputer power-saving mode when a predetermined amount of time has lapsed when the lock device remains at a fully-latched state.

CITATION LIST

Patent Literature

Patent Literature 1: Japanese Unexamined Patent Publication No. 2001-3620

SUMMARY OF THE INVENTION

Technical Problem

However, in the related art, the lock device only monitors the time at which the lock mechanism continuously remains in a fully-latched state, and no consideration is given to the power consumption of the microcomputer of the electronic control unit when the lock device is in an open state or remains at a half-latched state upon a long period of time elapsing, so that there is a risk of the battery, which supplies power to the microcomputer, going flat.

The present invention has been devised in consideration of the above-mentioned problems, and it is an objective to provide a lock device which can prevent a battery, for supplying power to a microcomputer of an electronic control unit, from going flat by reducing the consumption power of the microcomputer.

Solution to Problem

The present invention is characterized by a lock device including a lock mechanism which holds an opening-and-closing body, which opens and closes an opening in a vehicle body, at a position that closes the opening, the lock mechanism switching between an opening state, a half-latched state and a fully-latched state; an electronic control unit which operates in a microcomputer normal power mode or a microcomputer power-saving mode; and an open-state detector which detects the state of the lock mechanism. The electronic control unit transfers from the microcomputer normal power mode to the microcomputer power-saving mode when the open-state detector detects that the lock mechanism continuously remains at one of the opening state, the half-latched state and the fully-latched state for a predetermined period of time (e.g., seconds) when operating during the microcomputer normal power mode.

In the present specification, the term "open state" refers to the lock device between positioned toward an open state that is removed from the half-latched position, and does not necessarily refer to the opening-and-closing body of the lock device being in a fully-opened state.

The lock mechanism can be provided with a hook which is rotatable between a striker open position and a fully-latched position, and the open-state detector can detect the state of the lock mechanism by the rotational position of the hook.

The lock device of the present invention can further include a closure mechanism which switches the state of the lock mechanism from the half-latched state to the fully-latched state via driving of a motor, wherein the lock mechanism is provided with a ratchet which rotates between a latching position and an unlatching position, a sector gear which rotates in accordance with forward and reverse rotation of the motor, an open lever which rotates between an open position and a closed position in association with the rotation of the sector gear, a ratchet detection switch which detects the rotational position of the ratchet, a sector gear detection switch which detects that the sector gear has returned to an initial position after the state of the lock mechanism has changed, an open-lever detection switch which detects a rotational position of the open lever, and a opening operation switch which inputs an open-operation request via the closure mechanism. The electronic control unit, in the microcomputer normal power mode, monitors each of the ratchet detection switch, the sector gear detection switch, the open-lever detection switch and the opening operation switch at a predetermined clock frequency. In the microcomputer normal power mode, when the open-state detector detects that the lock mechanism continuously remains at the open state or the half-latched state for a predetermined period of time, the monitoring of the ratchet detection switch can be continued at the predetermined clock frequency while the monitoring of at least one of the sector gear detection switch, the open-lever detection switch and the opening operation switch at the predetermined clock frequency is stopped or continues monitoring at a clock frequency that is lower than the predetermined clock frequency.

The lock device of the present invention can further include a closure mechanism which switches the state of the lock mechanism from the half-latched state to the fully-latched state via driving of a motor, wherein the lock mechanism is provided with a ratchet which rotates between a latching position and an unlatching position, a sector gear which rotates in accordance with forward and reverse rotation of the motor, an open lever which rotates between an open position and a closed position in association with the rotation of the sector gear, a ratchet detection switch which detects the rotational position of the ratchet, a sector gear detection switch which detects that the sector gear has returned to an initial position after the state of the lock mechanism has changed, an open-lever detection switch which detects a rotational position of the open lever, and a opening operation switch which inputs an open-operation request via the closure mechanism. The electronic control unit, in the microcomputer normal power mode, monitors each of the ratchet detection switch, the sector gear detection switch, the open-lever detection switch and the opening operation switch at a predetermined clock frequency. In the microcomputer normal power mode, when the open-state detector detects that the lock mechanism continuously remains at the fully-latched state for a predetermined period of time, the monitoring of at least one of the ratchet detection switch, the sector gear detection switch, the open-lever detection switch and the opening operation switch at the predetermined clock frequency is stopped or continues monitoring at a clock frequency that is lower than the predetermined clock frequency.

In the microcomputer power-saving mode, when the ratchet detection switch detects that the rotational position of the ratchet has changed or when the open-operation request is input to the opening operation switch, the electronic control unit transfers from the microcomputer power-saving mode to the microcomputer normal power mode.

Advantageous Effects of the Invention

According to the invention pertaining to claim 1, when the lock mechanism continuously remains at one of the open state, the half-latched state and the fully-latched state for a predetermined period of time, since the operation mode of the electronic control unit transfers from the microcomputer normal power mode to the microcomputer power-saving mode, the power consumption of the microcomputer of the electronic control unit is reduced, and thereby can prevent the battery that supplies power to the microcomputer from going flat.

According to the invention pertaining to claim 2, the state of the lock mechanism can be quickly and reliably detected by the rotational position of the hook, which rotates between the striker open position and the fully-latched position.

According to the invention pertaining to claim 3, the present invention can be suitably applied to a lock device having a closure mechanism. Furthermore, in the microcomputer normal power mode, when the lock mechanism remains at the open state or the half-latched state for a predetermined period of time, since the electronic control unit transfers to the microcomputer power-saving mode, in which the electronic control unit continues to monitor the ratchet detection switch at a predetermined clock frequency and stops the monitoring of all other, or some of, the switches at a predetermined clock frequency via the switch monitor of the microcomputer, or monitors at a clock frequency that is lower than the predetermined clock frequency, the opening and closing control of the opening-and-closing body can be favorably carried out by the electronic control unit while lowering the power consumption of the microcomputer of the electronic control unit. In other words, since the ratchet detection switch is an important switch which can detect the switching state of the lock mechanism (open state, half-latched state, and fully-latched state) instantaneously, the electronic control unit, in the microcomputer power-saving mode, continues to monitor the ratchet detection switch at a predetermined clock frequency and stops the monitoring of all other, or some of, the switches at a predetermined clock frequency via the switch monitor of the microcomputer, or monitors at a clock frequency that is lower than the predetermined clock frequency.

According to the invention pertaining to claim 5, the present invention can be suitably applied to a lock device having a closure mechanism. Furthermore, in the microcomputer normal power mode, when the lock mechanism remains at the fully-latched state for the predetermined period of time, since the electronic control unit transfers to the microcomputer power-saving mode, in which the electronic control unit stops monitoring all, or some of, the ratchet detection switch, the sector-gear detection switch, the open-lever detection switch and the opening-operation switch at a predetermined clock frequency, or monitors at a clock frequency that is lower than the predetermined clock frequency, the power consumption of the microcomputer of the electronic control unit can be further reduced.

According to the invention pertaining to claim 4 and claim 6, the transferring from the microcomputer power-saving mode to the microcomputer normal power mode of the electronic control unit can be carried out at an appropriate timing.

BRIEF DESCRIPTION OF DRAWINGS

FIG. 13 is a diagram showing the monitoring states of each switch by a switch monitor of a microcomputer in a microcomputer normal power mode of the electronic control unit (ECU);

FIG. 14 is diagram showing the monitoring states of each switch by a switch monitor of the microcomputer in the microcomputer power-saving mode of the electronic control unit (ECU);

DESCRIPTION OF EMBODIMENTS

Figure 1:
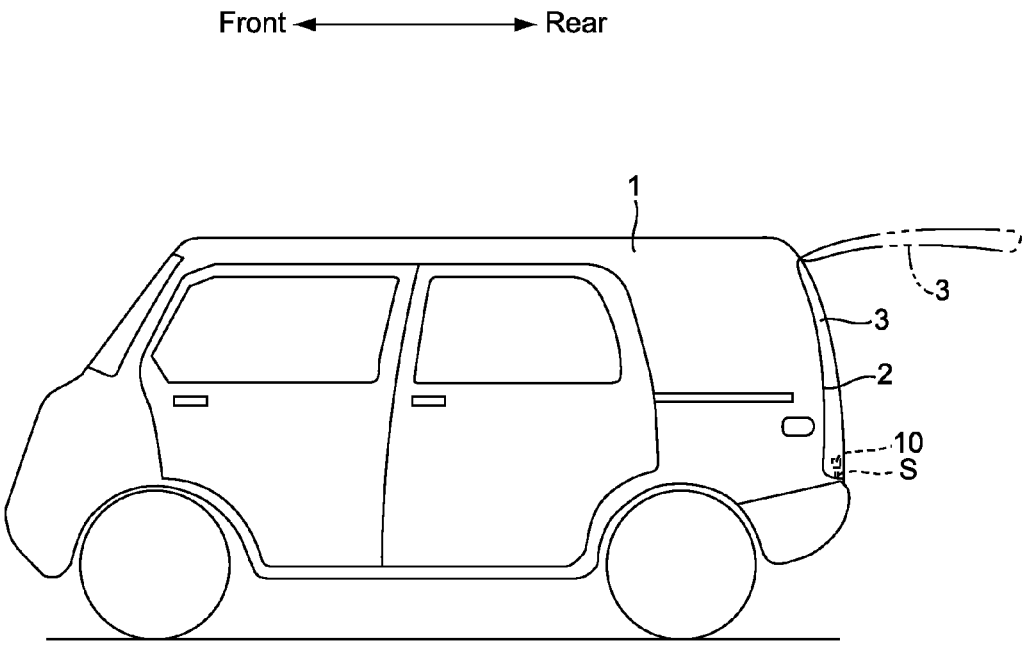
FIG. 1 is a side view of a vehicle door closure device, to which a lock device of the present invention is applied.

An embodiment of a lock device of the present invention, applied to a vehicle door closure device, will be hereinafter discussed with reference to FIGS. 1 through 19. As shown in FIG. 1, a door closure device (lock device) is provided with a back door (opening-and-closing body) 3 which opens and closes a rear opening (opening) 2 of a vehicle body 1. The back door 3 is mounted to the upper edge of the rear opening 2 to be rotatable about a rotational axis extending in the leftward/rightward direction (horizontal direction).

As shown in FIG. 1 and FIGS. 8 through 10, the door closure device (lock device) is provided with a lock mechanism 10 that is mounted onto the back door 3. Furthermore, a lower edge portion of the rear opening 2 of the vehicle body 1 is provided with a striker S, which disengageably engages with the lock mechanism 10. The lock mechanism 10 holds the back door 3 in a state which closes the rear opening 2, and the lock mechanism 10 switches between an open state, a half-latched state and a fully-latched state, in accordance with the opening amount of the back door 3 with respect to the rear opening 2.

Figure 2:
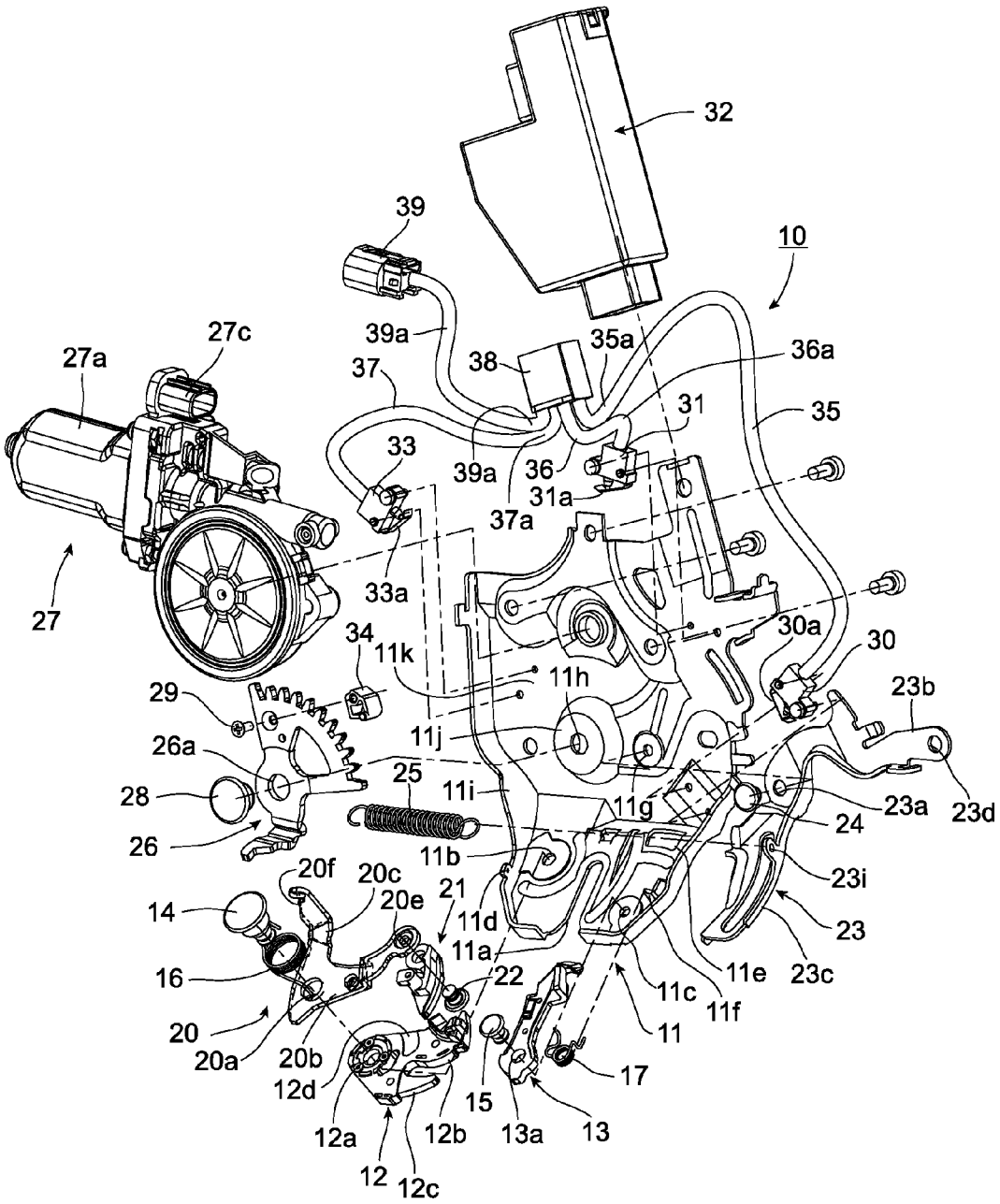
FIG. 2 is an exploded perspective view of the lock device.

As shown in FIG. 2, the lock mechanism 10 is provided with a metal base plate 11 that is fixedly attached to the back door 3. A striker entry groove 11*a*, into which the striker S can enter, is formed in the base plate 11, and a pivot pin 14 and a pivot pin 15 are fixed in shaft-supporting holes 11*b* and 11*c*, which are positioned on either side of the striker entry groove 11*a*. The pivot pin 14 is inserted through a shaft hole 12*a* formed in a hook 12, and the hook 12 is rotatably supported about the pivot pin 14. The pivot pin 15 is inserted through a shaft hole 13*a* formed in a ratchet 13, and the ratchet 13 is rotatably supported about the pivot pin 15.

Figure 3:
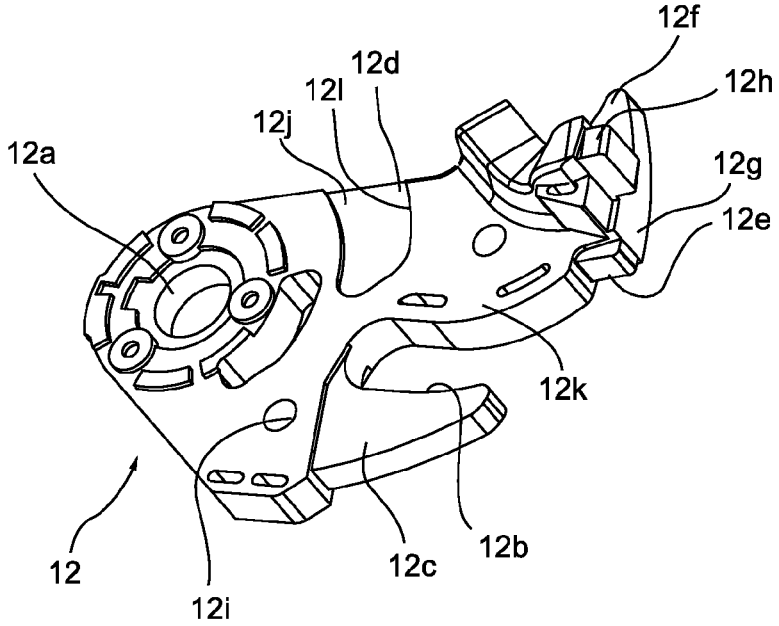
FIG. 3 is a perspective view showing a hook, of the lock device, as a basic element.

As shown in FIG. 3, a hook body 12*j*, which forms the base of the hook 12, is made of metal. The hook body 12*j* is provided with a striker holding groove 12*b*, which is formed in a substantially radial direction, centered about the shaft hole 12*a*, and a first leg portion 12*c* and a second leg portion 12*d* which are positioned on either side of the striker holding groove 12*b*. A ratchet-engaging stepped portion 12*e*, which faces the striker holding groove 12*b*, is provided near an end portion of the second leg 12*d*, and a ratchet pressure projection 12*f* is formed on the opposite side of the end portion of the second leg portion 12*d* with respect to the ratchet-engaging stepped portion 12*e*. In addition, an end of the second leg portion 12*d* which connects the ratchet-engaging stepped portion 12*e* and the ratchet pressure projection 12*f* to each other is formed into a convex-shaped circular arc surface 12*g*. Additionally, a coupling projection 12*h* is formed on the second leg portion 12*d* to project in a direction away from the base plate 11. The hook 12 is rotatable between a striker releasing position shown in FIG. 8 and a striker holding position shown in FIG. 10, and is biased to rotate toward the striker releasing position (clockwise direction with respect to FIGS. 8 through 10) by a torsion spring 16. The torsion spring 16 is provided with a coiled portion which surrounds the pivot pin 14 and a pair of spring ends which are engaged with a spring hooking hole 12*i* of the hook 12 and a spring hooking hole 11*d* of the base plate 11, respectively. A surface of the hook body 12*j* is covered with a hook cover 12*k* made of resin. However, the hook cover 12*k* exposes the first leg portion 12*c*, the ratchet-engaging stepped portion 12*e*, the ratchet pressure projection 12*f*, the circular arc surface 12*g* and the coupling projection 12*h*, and the hook cover 12*k* is provided with a cutout 121 for exposing the base of the second leg portion 12*d*.

Figure 4:
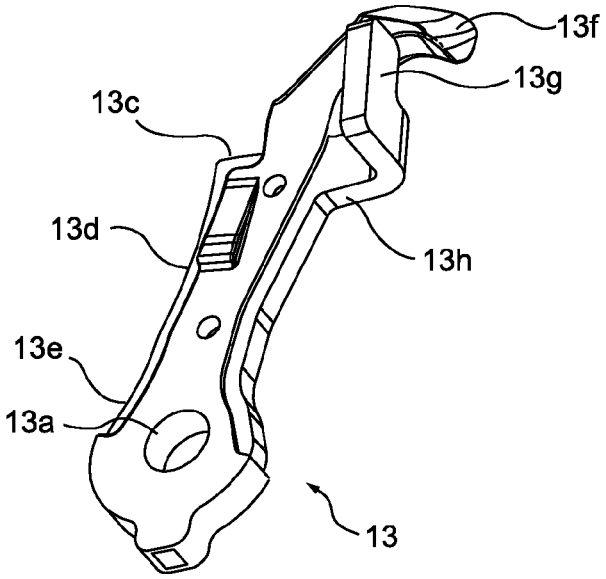
FIG. 4 is a perspective view showing a ratchet, of the lock device, as a basic element.

As shown in FIG. 4, the ratchet 13 is provided with a guide projection (not shown) which is engaged with a ratchet guide groove 11*e* formed in the base plate 11 to be slidable thereon. The ratchet 13 is provided, on a side thereof facing the hook 12, with a rotation-restriction stepped portion 13*c* which is engageable with the ratchet-engaging stepped portion 12*e*. A concave-shaped circular-arc surface portion 13*d*, which corresponds in shape to the circular arc surface 12*g* of the hook 12, is formed on a side surface of the ratchet 13 that is continuous with the rotation-restriction stepped portion 13*c*, and a smoothly-stepped portion 13*e* is formed on a portion of the circular-arc surface portion 13*d* in the vicinity of the base end of the ratchet 13 toward the pivotal hole 13*a*. Additionally, the ratchet 13 is provided, in the vicinity of the end thereof that is distant from the pivotal hole 13*a*, with a switch operating member 13*f*, and is provided with a pressed member 13*g* on the opposite side of the ratchet 13 from the circular-arc surface portion 13*d*. The ratchet 13 is rotatable between a latching position (FIGS. 8 and 10) in which the ratchet 13 is positioned close to the hook 12 so that the rotation-restriction stepped portion 13*c* is positioned in a moving path of the ratchet-engaging stepped portion 12*e* of the hook 12 (in which the rotation-restriction stepped portion 13*c* is engageable with the ratchet-engaging stepped portion 12*e*) and an unlatching position (FIG. 9) in which the rotation-restriction stepped portion 13*c* is retracted from a position in the moving path of the ratchet-engaging stepped portion 12*e* (in which the rotation-restriction stepped portion 13*c* is not engaged with the ratchet-engaging stepped portion 12*e*), and is biased to rotate toward the latching position (in the counterclockwise direction with respect to FIGS. 8 through 10) by a torsion spring 17. The torsion spring 17 is provided with a coiled portion which surrounds the pivot pin 15 and a pair of spring ends which are engaged with a spring hooking portion 13*h* of the ratchet 13 and a spring hooking hole 11*f* (see FIG. 2) of the base plate 11, respectively.

Figure 5:
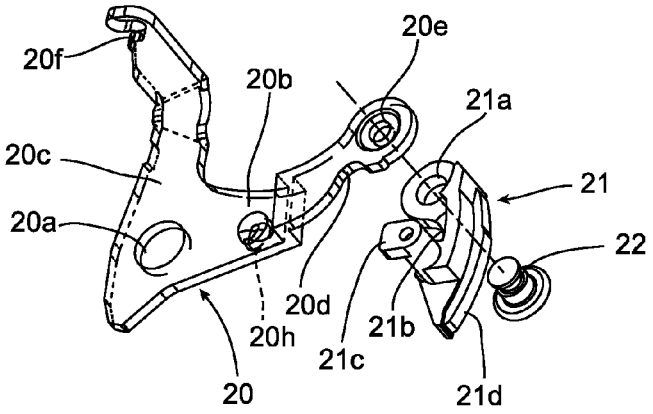
FIG. 5 is a perspective view of a closing lever and an inter-linked lever of the lock device.

The pivot pin 14 is also inserted into a pivotal hole 20*a* of a closing lever 20, and the closing lever 20 is supported by the pivot pin 14 to be rotatable independently about the pivot pin 14 relative to the hook 12. As shown in FIG. 5, the closing lever 20 is substantially L-shaped, has a first arm 20*b* and a second arm 20*c* which extend radially about the pivotal hole 20*a*, and is rotatable between a draw-in releasing position (FIGS. 8 and 9) in which the closing lever 20 is positioned toward the striker releasing position of the hook 12 that rotates coaxially with the closing lever 20, and a draw-in position (FIG. 10) in which the closing lever 20 is positioned toward the striker holding position of the hook 12.

A recess 20*d* with which the coupling projection 12*h* of the hook 12 can come into contact, and a pivot support hole 20*e*, in which a pivot pin 22 is inserted to be supported thereby, are formed on a portion of the closing lever 20 in the vicinity of the end of the first arm 20*b*. In addition, a sliding projection 20*h* which slides on the second leg portion 12*d* through the cutout 121 is projected from a surface of the closing lever 20 which faces the hook 12. The pivot pin 22 is inserted into a pivotal hole 21*a* of an interlinking lever 21, and the interlinking lever 21 is pivoted on the closing lever 20 to be rotatable about the pivot pin 22. As shown in FIG. 5, the interlinking lever 21 is provided on aside thereof with a coupling recess 21*b* having a shape corresponding to the shape of the coupling projection 12*h* of the hook 12, and the interlinking lever 21 is rotatable between a coupling position (in which the interlinking lever 21 is engageable with the coupling projection 12*h*) (FIGS. 9 and 10), in which the coupling recess 21*b* is positioned in a moving path of the coupling projection 12*h* of the hook 12, and a coupling disengaging position (in which the interlinking lever 21 is not engaged with the coupling projection 12*h*) (FIG. 8), in which the coupling recess 21*b* is retracted from a position in the moving path of the coupling projection 12*h* of the hook 12. The interlinking lever 21 is further provided in the vicinity of the coupling recess 21*b* with a control projection 21*c* which projects in a direction away from the base plate 11, and is provided with a ratchet pressure projection 21*d* at the end of the interlinking lever 21 on the opposite side from the base end thereof that includes the pivotal hole 21*a*.

Figure 6:
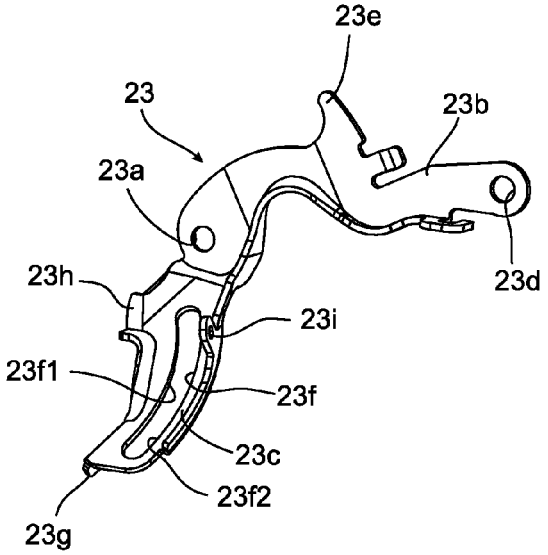
FIG. 6 is a perspective view showing an open lever, of the lock device, as a basic element.
Figure 8:
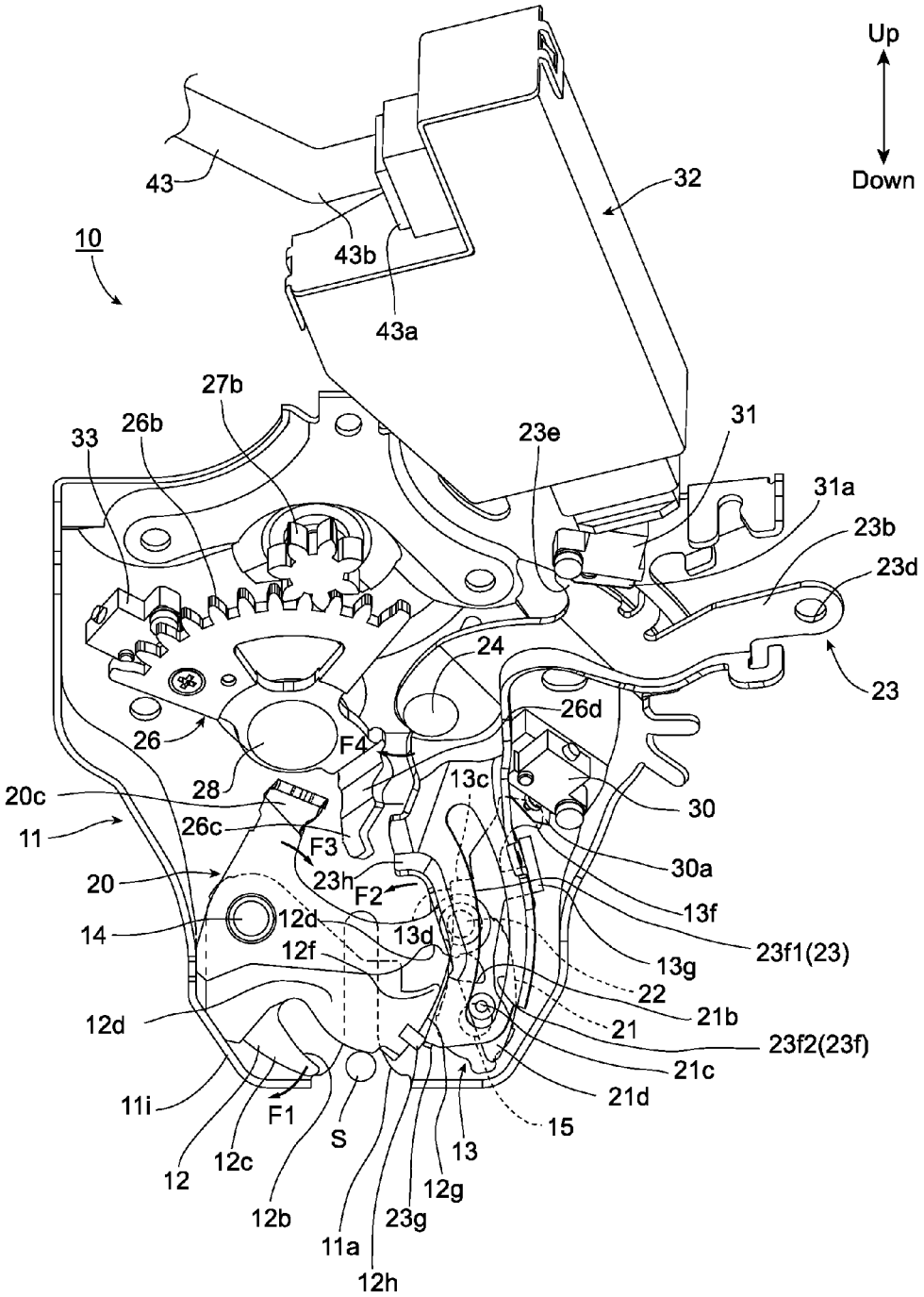
FIG. 8 is a plan view showing the lock device when a back door is positioned near a fully-closed position.
Figure 9:
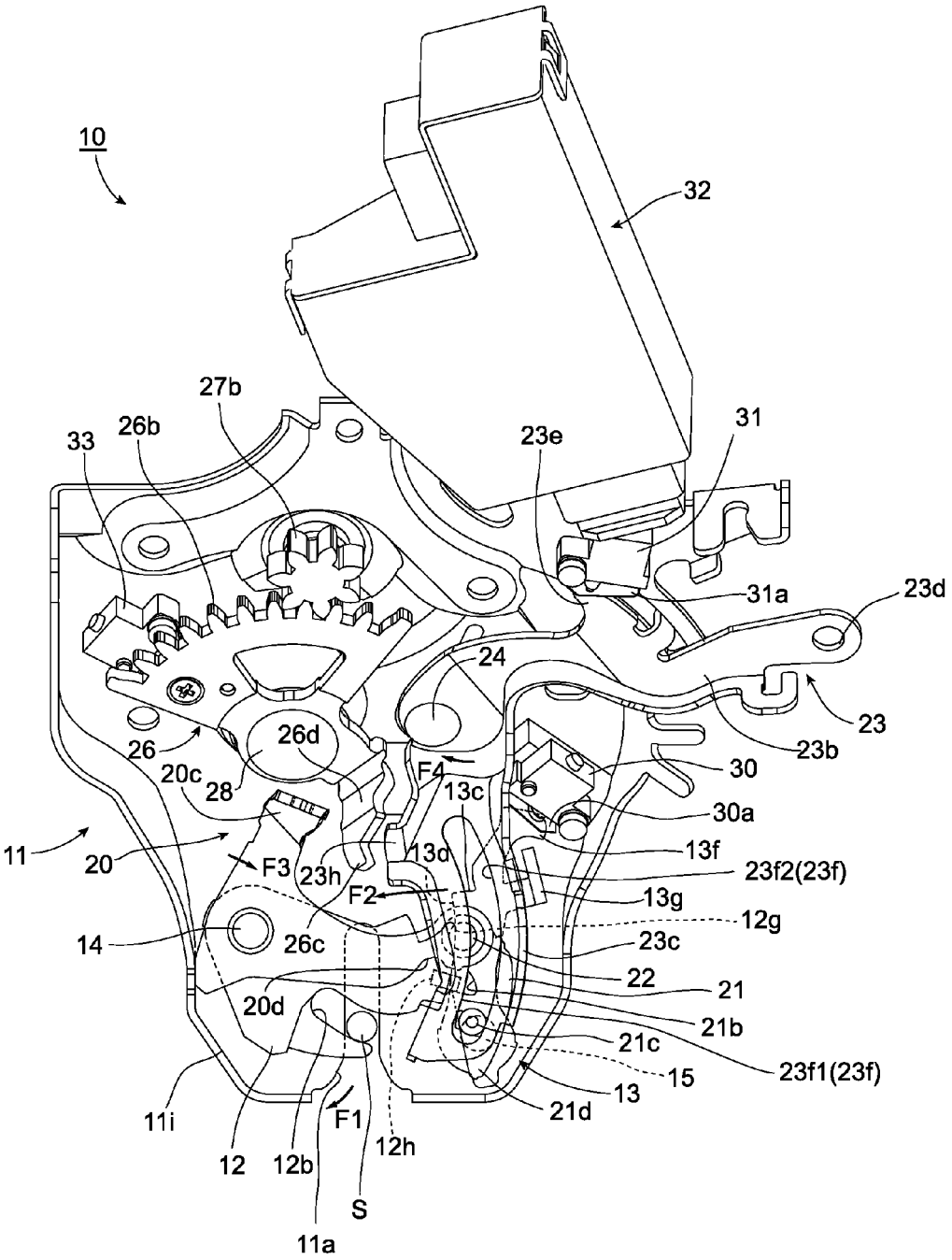
FIG. 9 is a plan view showing the lock device in a half-latched state.
Figure 10:
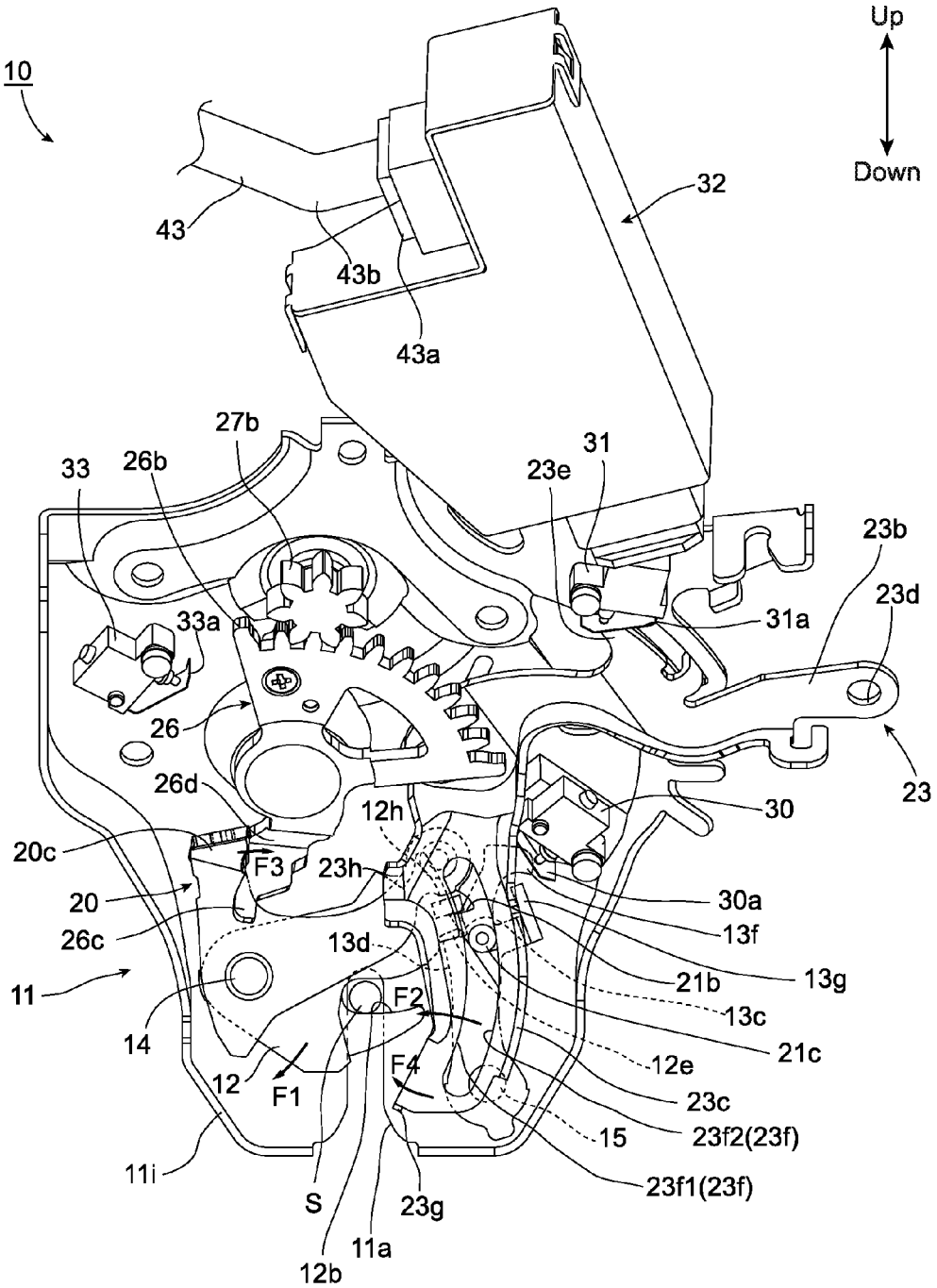
FIG. 10 is a plan view showing the lock device in a state where the operation of moving to a fully-latched state is completed.

A pivot pin 24 is fixed to a pivot support hole 11*g* of the base plate 11, and a pivotal hole 23*a* formed in an open lever 23 is rotatably fitted on the pivot pin 24. As shown in FIG. 6, the open lever 23 is provided with a first arm 23*b* and a second arm 23*c* which extend in different directions with the pivotal hole 23*a* as the center. The open lever 23 is provided in the vicinity of an end of the first arm 23*b* with a handle interlinking hole 23*d* that is linked with an end of an emergency release handle, not shown in the drawings, and is provided at a midpoint between the pivotal hole 23*a* and the handle interlinking hole 23*d* with a switch operating member 23*e*. In addition, the first arm 23*b* is linked with an end of a wire, the other end of which is linked with a key apparatus not shown in the drawings. The second arm 23*c* is positioned to generally overlay the ratchet 13 as viewed in a plan view as shown in FIGS. 8 through 10, and is provided with an interlinking-lever control hole 23*f* in which the control projection 21*c* of the interlinking lever 21 is inserted, a rotation restriction wall 23*g* that is capable of coming in contact with the coupling projection 12*h* of the hook 12, and a gear contact portion 23*h* which faces a sector gear 26, which will be discussed later. The interlinking-lever control hole 23*f* is a circular-arc-shaped elongated hole which progressively increases in width toward the end of the second arm 23*c* (toward the draw-in releasing position of the closing lever 20) from the side closer to the pivotal hole 23*a* (toward the draw-in position of the closing lever 20) and includes an inner arc surface 23*f*1 and an outer arc surface 23*f*2, the central axes of which are mutually different. The open lever 23 is rotatable between a closing position (FIGS. 9 and 10) at which the second arm 23*c* thereof, which has the interlinking-lever control hole 23*f*, is displaced toward the latching position of the ratchet 13, and an opening position (FIG. 8) at which the second arm 23*c* is displaced toward the unlatching position of the ratchet 13.

An extension spring 25 is extended and installed between a spring hook 20*f* formed on the second arm 20*c* of the closing lever 20 and a spring hook 23*i* formed on the second arm 23*c* of the open lever 23. The closing lever 20 is biased to rotate toward the aforementioned draw-in releasing position (clockwise direction with respect to FIGS. 8 through 10) by the extension spring 25, while the open lever 23 is biased to rotate toward the aforementioned closing position (clockwise direction with respect to FIGS. 8 through 10) by the extension spring 25.

Figure 7:
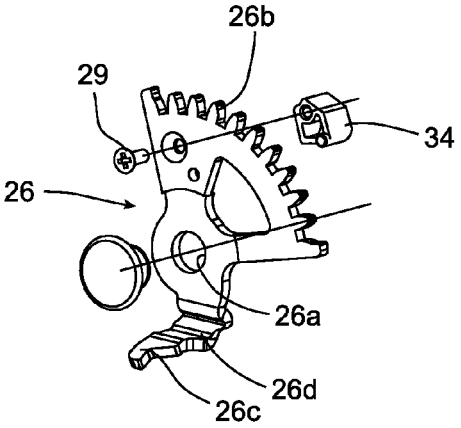
FIG. 7 is a perspective view of a sector gear and a press member, of the lock device, as basic elements.

A pivotal support hole 11*h* is formed in a support projection 11*j* which is projected from a portion of the base plate 11 in the vicinity of the center thereof, and a portion of the base plate 11 around the support projection 11*j* is formed as an annular stepped portion 11*k* which extends in a circumferential direction about the support projection 11*j*. A pivot pin 28 is fixed into the pivotal support hole 11*h*, and a pivotal hole 26*a* of the sector gear 26 that is made of metal is rotatably fitted on the pivot pin 28. As shown in FIG. 7, the sector gear 26 is provided with a gear portion 26*b* which is formed on the peripheral edge of a sector portion of the sector gear 26 about the pivotal hole 26*a*, an open-lever operating piece 26*c* which is capable of coming in contact with the gear contact portion 23*h* of the open lever 23, and a closing lever operating portion 26*d* which is continuous with the open-lever operating piece 26*c* and capable of engaging with the second arm 20*c* of the closing lever 20. As shown in FIG. 7, the open-lever operating piece 26*c* and the closing lever operating portion 26*d* are substantially orthogonal to the other part of the sector gear 26, and the closing lever operating portion 26*d* is formed to have a greater width than that of the open-lever operating piece 26*c*. Additionally, a pressing member 34 made of synthetic resin is fixed to the sector gear 26 by a screw 29, and the pressing member 34 forms a minute clearance between the pressing member 34 and the annular stepped portion 11*k*. A motor unit 27 fixed on the base plate 11 is provided with a pinion 27*b* which is driven to rotate forward and reverse by a motor 27*a*, and the pinion 27*b* is engaged with the gear portion 26*b*. The motor unit 27 and the sector gear 26 constitute a closure mechanism which switches between the half-latched state and the fully-latched state of the opening state of the back door 3 via the driving of the motor.

A ratchet detection switch (open-state detector) 30 and an open-lever detection switch (open-state detector) 31 are mounted on the base plate 11. The ratchet detection switch 30 is a switch which can be pressed by the switch operating member 13*f* that is provided on the ratchet 13, and the open-lever detection switch 31 is a switch which can be pressed by the switch operating member 23*e* that is provided on the open lever 23. More specifically, the ratchet detection switch 30 is in a switch-OFF state, in which the switch operating member 13*f* is spaced from a switch leaf 30*a*, when the ratchet 13 is in the latching position shown in FIGS. 8 and 10, and the switch operating member 13*f* presses the switch leaf 30*a* to thereby turn ON the ratchet detection switch 30 upon the ratchet 13 being rotated to the unlatching position shown in FIG. 9. In addition, the open-lever detection switch 31 is in a switch-OFF state in which the switch operating member 23*e* is spaced from a switch leaf 31*a* when the open lever 23 is in the closing position shown in FIGS. 9 and 10, and the switch operating member 23*e* presses the switch leaf 31*a* to thereby turn ON the open-lever detection switch 31 upon the open lever 23 being rotated to the opening position shown in FIG. 8. The ON/OFF states of the ratchet detection switch 30 and the open-lever detection switch 31 are input to an electronic control unit (ECU) 32, and the electronic control unit 32 controls the operation of the motor unit 27 in a manner which will be discussed later.

The lock mechanism 10 is also provided with a sector gear detection switch 33 (FIGS. 2, 8, etc.), provided with a switch leaf 33*a*, for detecting an initial position of the sector gear 26, and an opening operation switch (open switch) 33A (FIG. 12), to which an open operation command is input for performing a motor-driven opening operation. As shown in the drawings, the sector gear detection switch 33 is fixed to the annular stepped portion 11*k* of the base plate 11 by a screw, and both the switch leaf 33*a* and the pressing member 34 lie on a single plane that is parallel to the rotational direction of the sector gear 26.

Figure 11:
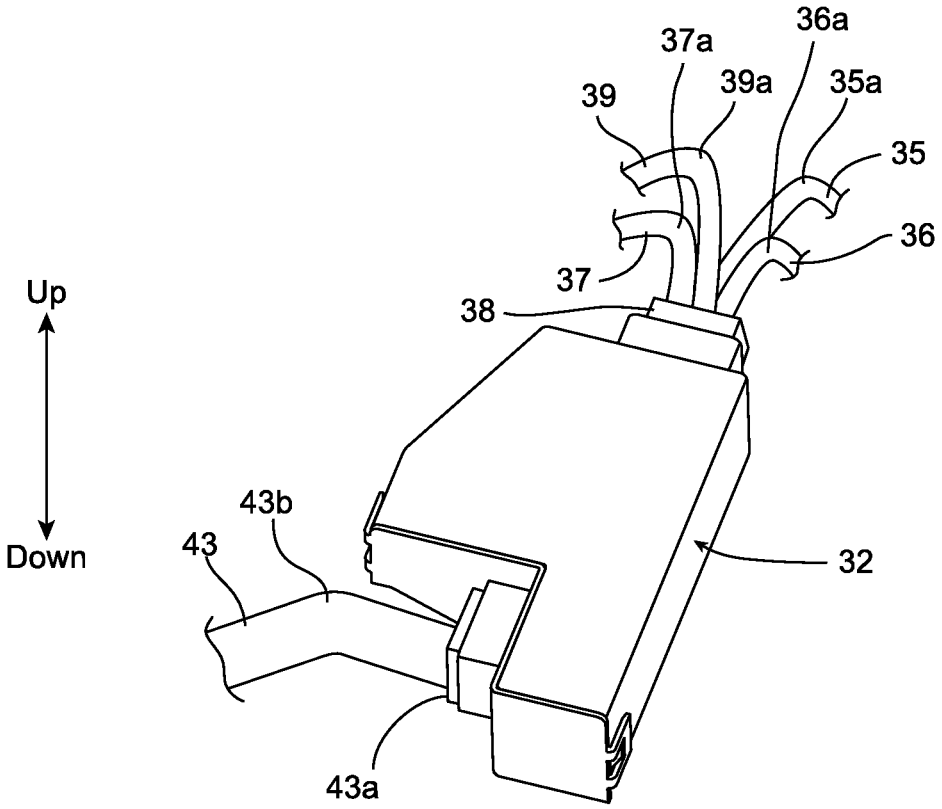
FIG. 11 is a perspective view of an electronic control unit (ECU) and peripheral members thereof when the back door is positioned at the fully-open position.

As shown in FIG. 2, wire harnesses 35, 36 and 37, which are flexible as a whole and are provided with harnesses made of a conductive material and tubular sheaths made of an insulating material that cover the peripheries of the harnesses, are connected at one end of the wire harnesses 35, 36 and 37 to the ratchet detection switch 30, the open-lever detection switch 31 and the sector gear detection switch 33, respectively, and the other end of the wire harnesses 35, 36 and 37 are connected to a connector 38. An end of a wire harness 39 which is identical in structure to the wire harnesses 35, 36 and 37 is connected to the connector 38, and the wire harness 39 is provided at the other end thereof with a connector 39*a* which is connected to a socket 27*c* of the motor unit 27. As shown in FIGS. 2 and 11, bent portions 35*a*, 36*a*, 37*a* and 39*a* are formed on portions of the wire harnesses 35, 36, 37 and 39 in the vicinity of the ends thereof on the connector 38 side, respectively. Accordingly, when the back door 3 is positioned in the vicinity of the fully-closed position or the fully-closed position, the wire harnesses 35, 36, 37 and 39 extend obliquely downwards from the connector 38 toward the bent portions 35*a*, 36*a*, 37*a* and 39*a*, respectively, and portions of the wire harnesses 35, 36, 37 and 39 beyond the bent portions 35*a*, 36*a*, 37*a* and 39*a* extend obliquely upward from the bent portions 35*a*, 36*a*, 37*a* and 39*a*, respectively.

The electronic control unit 32 is fixed to the end of the base plate 11 on the opposite side from the striker entry groove 11*a* by a plurality of screws. As shown in the drawings, the axis of the electronic control unit 32, which fixed to the base plate 11, is inclined with respect to the vertical direction.

A connector (male connector) 43*a* (see FIGS. 8, 10 and 11) provided at an end of a wire harness 43 (having the same structure as the wire harnesses 35, 36 and 37) electrically connected to a battery (not shown; for supplying power to the motor 27*a*, the ratchet detection switch 30, the open-lever detection switch 31, the electronic control unit 32, the sector gear position detection switch 33, and the opening operation switch 33A etc.) provided in the vehicle body 1 is connected to the electronic control unit 32. As shown in FIGS. 8, 10 and 11, the wire harness 43 is provided with a bent portion 43*b* in the vicinity of the end of the wire harness 43 on the connector 43*a* side. Accordingly, when the back door 3 is positioned in the vicinity of the fully-closed position or the fully-closed position, the wire harness 43 extends obliquely downwards from the connector 43*a* toward the bent portion 43*b*, and the portion of the wire harness 43 from the bent portion 43*b* onwards extends obliquely upward.

Furthermore, the connector 38, which is provided at end of the wire harnesses 35, 36, 37 and 39 which are electrically connected to the ratchet detection switch 30, the open-lever detection switch 31, the sector gear position detection switch 33 and the motor unit 27, is connected to the electronic control unit 32.

Figure 12:
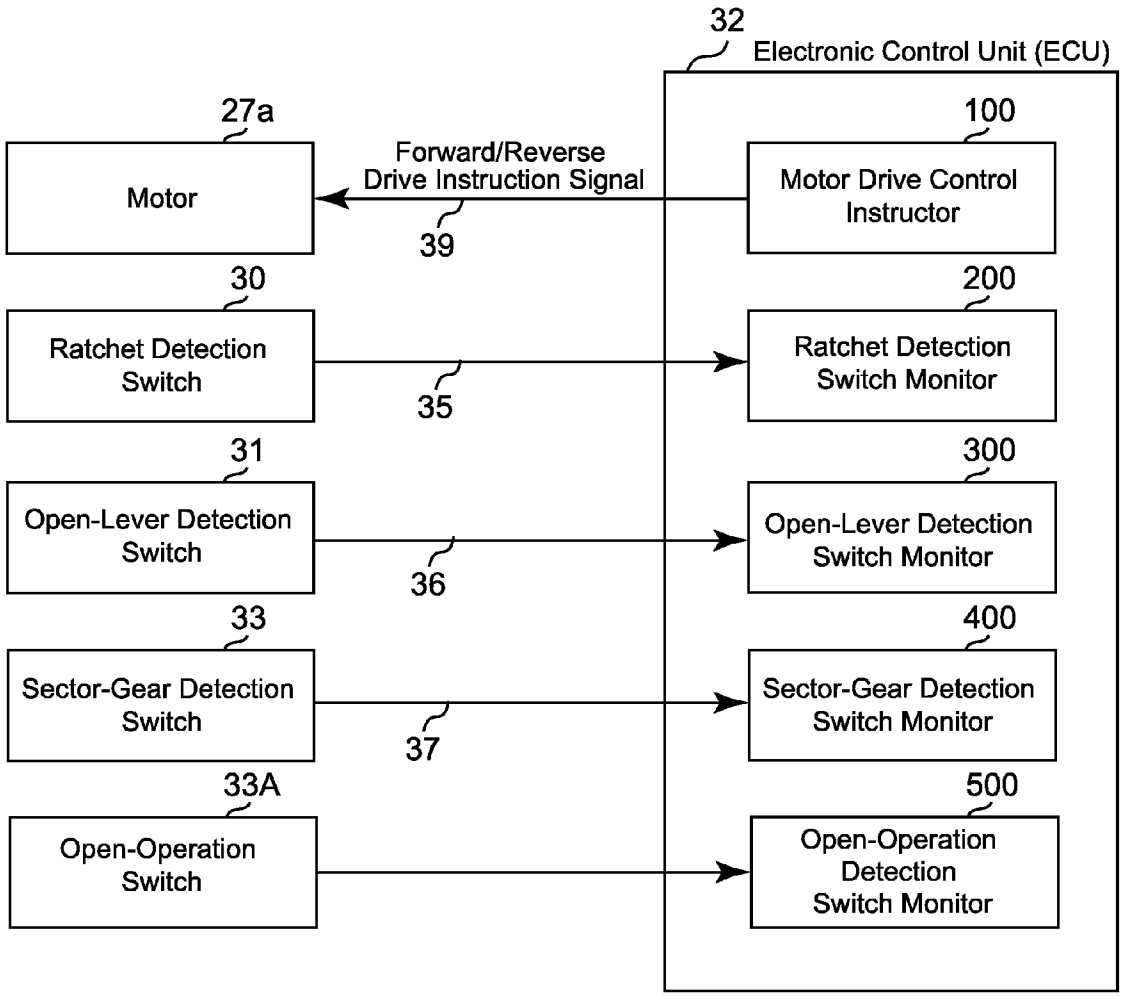
FIG. 12 is a function block diagram showing the internal structure of the electronic control unit (ECU)

FIG. 12 is a function block diagram showing the internal structure of the electronic control unit (ECU) 32. The electronic control unit 32 is provided with a microcomputer that includes a motor drive control instructor 100, a ratchet detection switch monitor 200, an open-lever detection switch monitor 300, a sector-gear detection switch monitor 400, and an open-operation detection switch monitor 500.

The motor drive control instructor 100 is connected to a motor 27*a* of the motor unit 27 via the wire harness 39. The motor drive control instructor 100 sends a forward-drive instruction signal for a closing direction of the back door 3 (in a door locking direction) or a reverse-drive instruction signal for an opening direction of the back door 3 to the motor 27*a*.

The ratchet detection switch monitor 200 is connected to the ratchet detection switch 30 via the wire harness 35. The ratchet detection switch monitor 200 monitors the ON/OFF state of the ratchet detection switch 30.

The open-lever detection switch monitor 300 is connected to the open-lever detection switch 31 via the wire harness 36. The open-lever detection switch monitor 300 monitors the ON/OFF state of the open-lever detection switch 31.

The sector-gear detection switch monitor 400 is connected to the sector gear detection switch 33 via the wire harness 37. The sector-gear detection switch monitor 400 monitors the ON/OFF state of the sector gear detection switch 33.

The open-operation detection switch monitor 500 is connected to the opening operation switch 33A via a wire harness, not shown. The open-operation detection switch monitor 500 monitors the input signals of the opening operation switch 33A.

The electronic control unit 32 operates in the microcomputer normal power mode or the microcomputer power-saving power mode and controls the opening and closing operation of the back door 3 via the lock mechanism 10.

As shown in FIG. 13, in the microcomputer normal power mode of the electronic control unit 32, the ratchet detection switch monitor 200, the open-lever detection switch monitor 300, the sector-gear detection switch monitor 400 and the open-operation detection switch monitor 500 respectively monitor each of the ratchet detection switch 30, the open-lever detection switch 31, the sector gear detection switch 33, and the opening operation switch 33A, at a predetermined clock frequency X(Hz).

As shown in FIG. 14, in the microcomputer power-saving power mode of the electronic control unit 32, the ratchet detection switch monitor 200 and the open-operation detection switch monitor 500 monitor the ratchet detection switch 30 and the opening operation switch 33A at the same predetermined clock frequency X(Hz) as that in the microcomputer normal power mode. Whereas, the remaining open-lever detection switch monitor 300 and the sector-gear detection switch monitor 400 either stop monitoring the open-lever detection switch 31 and the sector gear detection switch 33 at the predetermined clock frequency X(Hz) of the microcomputer normal power mode, or monitor at a clock frequency x(Hz) that is lower than the predetermined clock frequency X(Hz) of the microcomputer normal power mode.

The manner in which the electronic control unit 32 transfers the operational mode thereof between the microcomputer normal power mode and the microcomputer power-saving power mode will be described in detail later.

Figure 15:
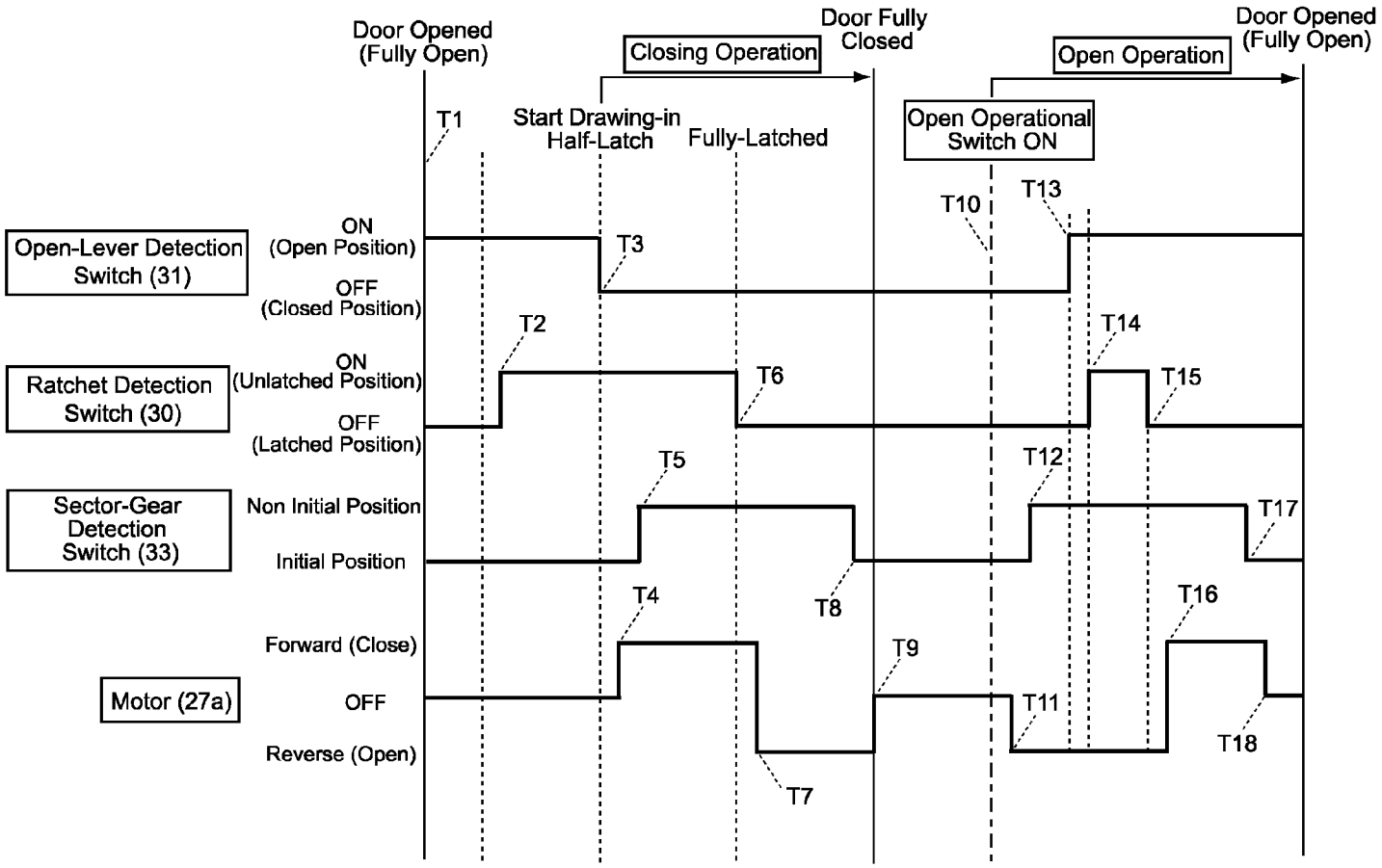
FIG. 15 is a timing chart showing the normal operational states of the lock device.
Figure 16:
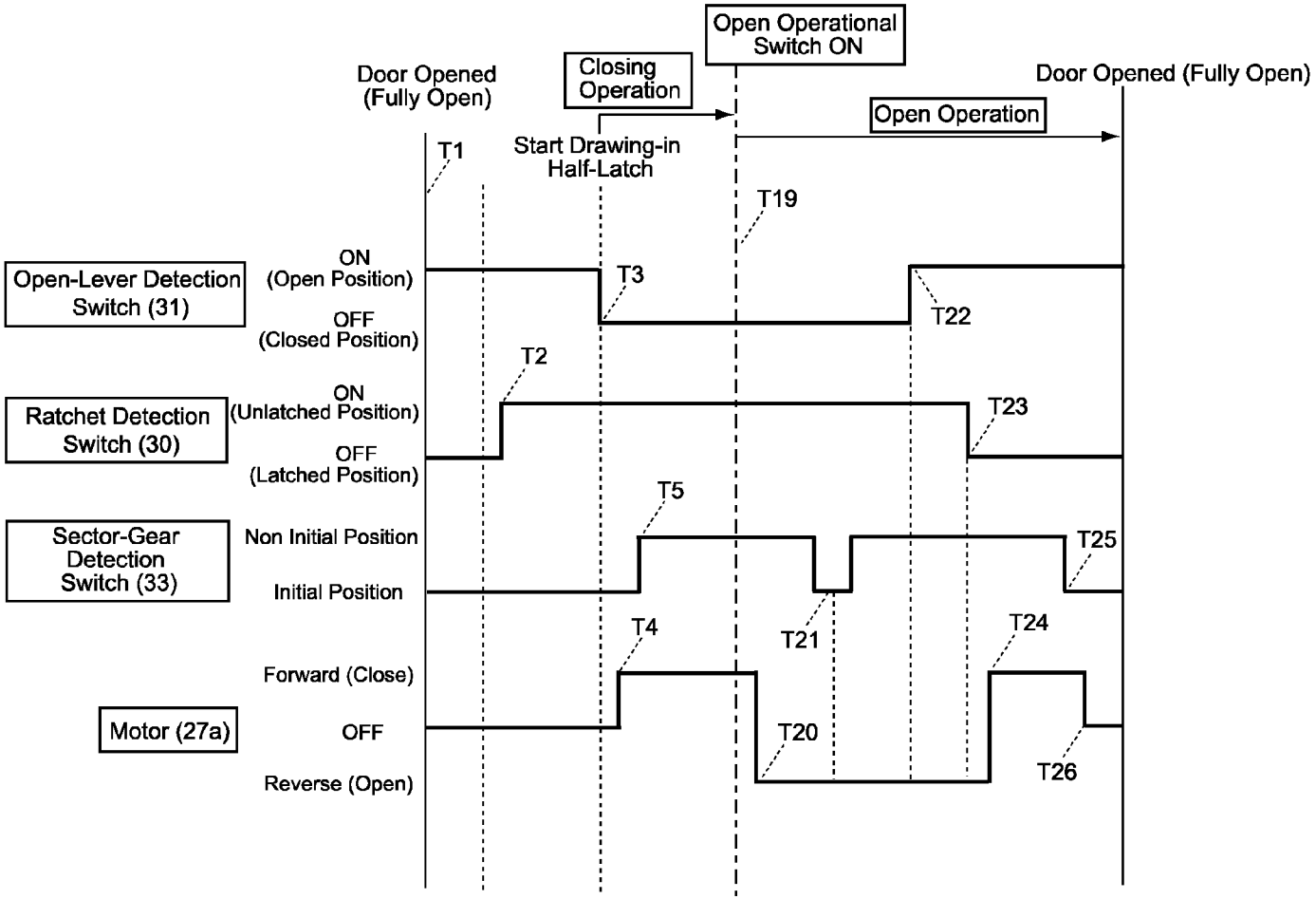
FIG. 16 is a timing chart of the case where an electrically driven open (cancellation of closing operation) operation is carried out from the half-latched state to the fully-latched state.
Figure 17:
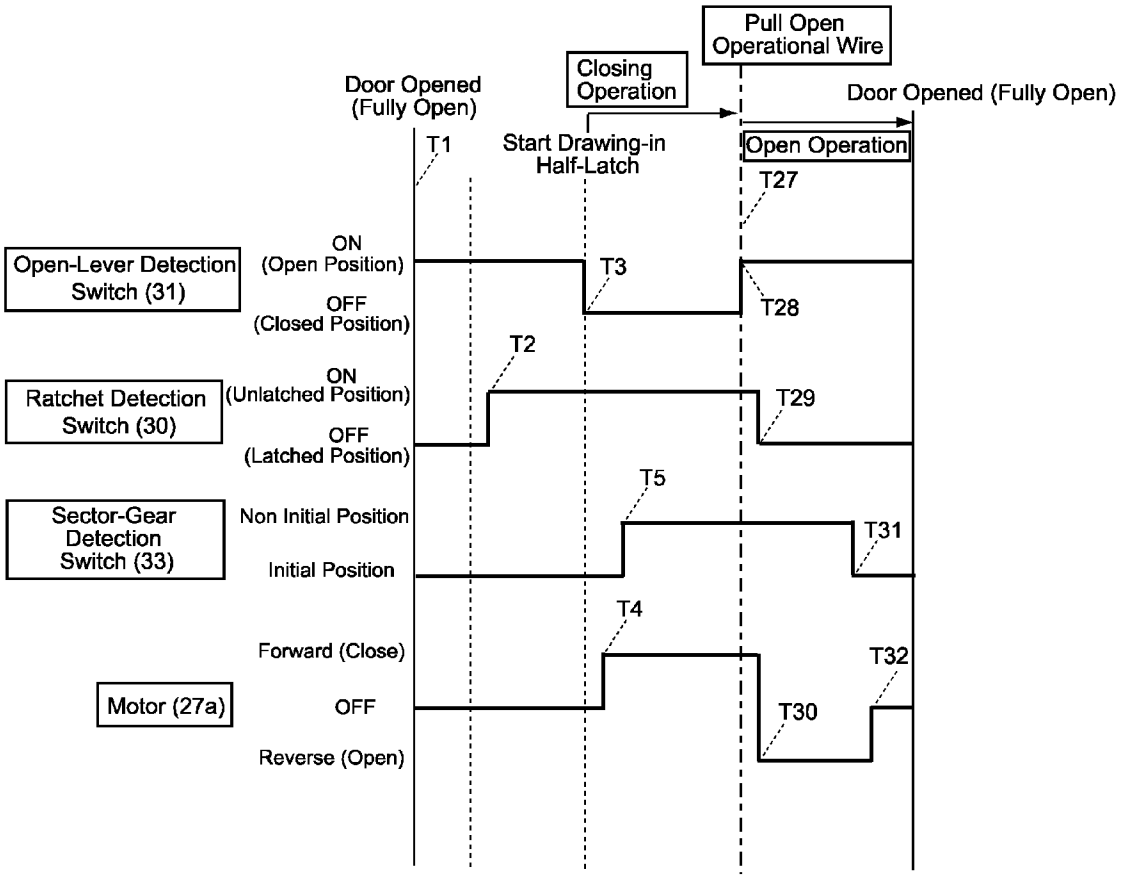
FIG. 17 is a timing chart of the case where a mechanical open (cancellation of closing operation) operation is carried out somewhere between the half-latched state and the fully-latched state.

Operations of the lock mechanism 10 having the above-described configuration will be described with reference to mainly FIGS. 8 through 10, and FIGS. 15 through 17. FIGS. 8 through 10 show an embodiment of the mechanical operation of the lock mechanism 10, and FIGS. 15 through 17 are timing charts showing the electrical control of the lock mechanism 10. In the mechanical diagrams, F1, F2, F3 and F4 respectively indicate the directions of biasing spring forces acting on the hook 12, the ratchet 13, the closing lever 20 and the open lever 23. The rotational direction of each of the following members is the rotational direction with respect to FIGS. 8 through 10. Furthermore, in regard to the driving direction of the motor 27*a*, the closing (locking) direction of the door is the forward direction and the door lock releasing direction is the reverse direction.

First, the normal operations shown in FIG. 15 will be discussed. FIG. 8 shows a lock mechanism. 10 in an opened state of the back door 3 (in a state where the back door 3 is positioned in the close vicinity of the fully-closed position) shown as T1 in the timing chart of FIG. 15.

At this stage, the hook 12 is positioned at the striker release position so that the second leg portion 12*d* is positioned over the striker entry groove 11*a* and the first leg portion 12*c* is retracted from the striker entry groove 11*a*, and the ratchet 13 is rotated in a direction approaching the hook 12 to the latching position. As mentioned above, when the ratchet 13 is in the latching position, the switch operating member 13*f* does not press the switch leaf 30*a* of the ratchet detection switch 30, and the ratchet detection switch 30 is in a switch-OFF state. The positions of the hook 12 and the ratchet 13 are respectively maintained by the biasing force F1 of the torsion spring 16 and the biasing force F2 of the torsion spring 17. Specifically, the hook 12 is restricted from rotating any further in the F1 direction by a side surface thereof abutting against an upright wall 11*i* of the base plate 11, and the ratchet 13 is restricted from rotating any further in the F2 direction by the above-mentioned guide projection (not shown) abutting against an end of the ratchet guide groove 11*e*.

In the opened state, of the back door 3, of FIG. 8, since the closing lever 20 is held at the draw-in releasing position by a side surface of the closing lever 20 contacting the upright wall 11*i*, the control projection 21*c* of the interlinking lever 21 that is pivoted on the closing lever 20 about the pivot pin 22 is positioned upwardly away from the edge surface of the lower end of the interlinking-lever control groove 23*f* of the open lever 23, and the control projection 21*c* is restricted from rotating any further in the biasing F3 direction of the extension spring 25. At this stage, the biasing force F3 that the extension spring 25 applies against the closing lever 20 acts in a pressing direction of the control projection 21*c* of the interlinking lever 21 against the inner arc surface 23*f*1 of the interlinking-lever control groove 23*f*; and the interlinking lever 21 is held at the coupling disengaging position at which the interlinking lever 21 cannot engage with the coupling projection 12*h* of the hook 12 due to the control projection 21*c* abutting against the inner arc surface 23*f*1. Furthermore, the open-lever operating piece 26*c* of the sector gear 26 contacts the gear contact portion 23*h* of the open lever 23 while the closing lever operating portion 26*d* is positioned away from the second arm 20*c* of the closing lever 20, which is positioned at the draw-in release position. This position is the initial position of the sector gear 26 which the sector gear detection switch 33 detects by the pressing member 34, that is fixed to the sector gear 26, pressing the switch piece 33*a*. The open lever 23 is held at the open position by the rotation restriction wall 23*g* abutting against the coupling projection 12*h* of the hook 12 so that the rotation of the open lever 23 is restricted in the direction of the biasing force F4 of the extension spring 25. As mentioned above, when the open lever 23 is at the open position, the switch operating member 23*e* presses against the switch leaf 31*a* of open-lever detection switch 31, so that the open-lever detection switch 31 is in a switched ON state. Thereafter, the electronic control unit 32 detects the open state of the back door 3 by an input-signal combination of the open-lever detection switch 31 being ON and the ratchet detection switch 30 being OFF.

When the striker S enters into the striker entry groove 11*a* and presses against the second leg portion 12*d* in the closing operation of the back door 3, the hook 12 holds the striker S inside the striker holding groove 12*b* while rotating in the counterclockwise direction from the striker release position of FIG. 8 toward the draw-in commencement position of FIG. 10 against the biasing force F1 of the torsion spring 16. Subsequently, the ratchet pressure projection 12*f* of the hook 12 pushes into the stepped portion 13*e* of the ratchet 13 and the ratchet 13 rotates, against the biasing force F2 of the torsion spring 17, in the clockwise direction from the latching position of FIG. 8 to the unlatching position shown in FIG. 10. When the ratchet 13 rotates to the unlatching position, the switch operating member 13*f* presses against the switch leaf 30*a*, and the ratchet detection switch 30 switches from OFF to ON (T2).

The rotation restriction wall 23*g* of the open lever 23 has a predetermined length in the elongated direction of the second arm 23*c*; and until immediately before the hook 12 reaches the draw-in commencement position of FIG. 9 from the striker release position of FIG. 8, the rotation restriction wall 23*g* abuts against the coupling projection 12*h* of the hook 12 and the open lever 23 is restricted from rotating toward the closed position (clockwise direction) to be continuously held at the open position. Thereafter, upon the hook 12 reaching the draw-in commencement position of FIG. 9, the coupling projection 12*h* of the hook 12 deviates from the position facing the rotation restriction wall 23*g* thereby releasing the rotational restriction, so that the open lever 23 rotates to the closing position shown in FIG. 9 by the biasing force F4 of the extension spring 25 (T3). When the open lever 23 is rotated to the closing position, since the outer arc surface 23*f*2 of the open lever 23 pushes the control projection 21*c* of the interlinking lever 21 toward the closing position, the interlinking lever 21 rotates in the clockwise direction about the pivot pin 22 by the biasing force F3 of the extension spring 25, and moves from the coupling disengaging position shown in FIG. 8 to the coupling position of FIG. 9. Accordingly, since the coupling projection 12*h* of the hook 12 comes in contact with the base of the coupling recess 21*b* of the interlinking lever 21, the hook 12 is held in the draw-in commencement position by the interlinking lever 21. This state corresponds to the half-latched state shown in FIG. 9. During the transition of the lock mechanism 10 from the door-open state shown in FIG. 8 to the half-latched state shown in FIG. 9 (including the time the hook 12 is in the striker releasing position and the time the hook 12 is in the draw-in commencement position), the side surface of the closing lever 20 continues to contact the upright wall 11*i*, so that the closing lever 20 is held in the draw-in releasing position even when the lock mechanism 10 is in the half-latched state. The rotation of the opening lever 23 to the closing position causes the switch operating piece 23*e* to stop pressing the switch leaf 31*a*, thus causing the opening lever detection switch 31 to be turned OFF from the ON state (T3). Thereafter, the electronic control unit 32 detects the half-latched state of the back door 3 from a combination of an input signal indicating an ON state of the ratchet detection switch 30 and an input signal indicating an OFF state of the opening lever detection switch 31.

The interlinking lever 21 and the opening lever 23 are both rotated in the clockwise direction when the back door 3 moves from the open state (a state where it is positioned in the vicinity of the fully-closed position) shown in FIG. 8 to the half-latched state shown in FIG. 9; however, during such clockwise rotation of the interlinking lever 21 and the opening lever 23, the control projection 21*c* of the interlinking lever relatively changes the position thereof in the interlinking-lever control groove 23*f* in the widthwise direction thereof to change to the state (shown in FIG. 9) in which the control projection 21*c* is in contact with the outer arc surface 23*f*2. Additionally, in this state, the interlinking lever 21 is prevented from rotating toward the coupling disengaging position by the contacting relationship between the control projection 21*c* and the outer arc surface 23*f*2.

Upon the detection of the half-latched state, the electronic control unit 32 drives the motor 27*a* of the motor unit 27 in the forward direction (T4). Thereupon, due to the engagement between the pinion 27*b* and the gear portion 26*b*, the sector gear 26 is rotated in the clockwise direction with respect to FIG. 9 (T5), and this rotation of the sector gear 26 causes the closing lever operating portion 26*d* to press the second arm 20*c* of the closing lever 20 to thereby rotate the closing lever 20 in the counterclockwise direction from the draw-in releasing position shown in FIG. 9 to the draw-in position shown in FIG. 10. This also causes the hook 12, which is integrated with the closing lever 20 via the interlinking lever 21 (and is prevented from rotating toward the striker releasing position by the coupling recess 21*b*), to rotate in the counterclockwise direction from the draw-in commencement position shown in FIG. 9 to the striker holding position shown in FIG. 10, so that the striker S is drawn deeply into the striker entry groove 11*a* by the striker holding groove 12*b* of the hook 12. At this stage, the interlinking lever 21 moves integrally with the closing lever 20 about the pivot pin 14 while making the control projection 21*c* slide on the outer arc surface 23*f*2 of the interlinking-lever control groove 23*f* (at this time the rotational center of the outer arc surface 23*f*2 is coincident with the pivot pin 14) with the coupling recess 21*b* and the coupling projection 12*h* remaining engaged with each other. Additionally, during the time the opening lever 23 is held in the closing position, the interlinking lever 21 is prevented from rotating (rotating on the pivot pin 22) in a direction (toward the coupling disengaging position) to release the engagement between the coupling recess 21*b* and the coupling projection 12*h* by the engagement between the outer arc surface 23*f*2 and the control projection 21*c*. In other words, the outer arc surface 23*f*2 functions as a guide surface which determines the path of the rotational movement of the interlinking lever 21 during the closing operation of the back door 3 from the half-latched state.

During the rotation of the combination of the hook 12 and the closing lever 20 in the draw-in direction of the striker S from the half-latched state shown in FIG. 9, the circular arc surface 12*g* that is formed at the end of the second leg portion 12*d* of the hook 12 comes in sliding contact with the circular-arc surface portion 13*d* of the ratchet 13, and the ratchet 13 is held in the unlatching position against the biasing force F2 of the torsion spring 17 in a manner similar to the case of the half-latched state shown in FIG. 9. During this stage, the opening lever 23 is also held in the closing position in a manner similar to the case in the half-latched state. Namely, a state where the ratchet detection switch 30 and the opening lever detection switch 31 are ON and OFF, respectively, continues. Thereafter, a rotation of the hook 12 to the striker holding position shown in FIG. 10 causes the circular arc surface 12*g* to escape upward from a position facing the circular-arc surface portion 13*d* to thereby release the prevention of rotation of the ratchet 13 so that the ratchet rotates toward the latching position (in the counterclockwise direction) from the unlatching position by the biasing force F2 of the torsion spring 17, so that the rotation-restriction stepped portion 13*c* is engaged with the ratchet-engaging stepped portion 12*e* as shown in FIG. 10. Due to this engagement between the rotation-restriction stepped portion 13*c* and the ratchet-engaging stepped portion 12*e*, the hook 12 is prevented from rotating in the direction toward the striker releasing position, so that the lock mechanism 10 comes into the fully-latched state (the door fully-closed state), in which the striker S is completely held in the inner part of the striker entry groove 11*a*. The counterclockwise rotation of the ratchet 13 when the rotation-restriction stepped portion 13*c* is brought into engagement with the ratchet-engaging stepped portion 12*e* causes the switch operating piece 13*f* to stop pressing the switch leaf 30*a*, thus causing the ratchet detection switch 30 to be turned OFF from the ON state (T6). Namely, each of the ratchet detection switch 30 and the opening lever detection switch 31 is turned OFF, thereby the fully-latched state being detected.

Upon the detection of the fully-latched state, the electronic control unit 32 continues to drive the motor 27*a* in the forward direction by a predetermined overstroke amount in order to ensure a latched state and thereafter drives the motor 27*a* reversely in the door opening direction (T7). This reverse driving of the motor 27*a* is for returning the sector gear 26 which has been rotated to the position shown in FIG. 10 by the closing operation to the initial position shown in FIG. 8, and upon the sector gear detection switch 33 detecting, by the pressure of the pressing member 34 against the switch leaf 33*a*, that the sector gear 26 has returned to the initial position thereof (T8), the motor 27*a* is stopped (T9). In this state in which the motor is stopped, the closing lever operating portion 26*d* is disengaged from the second arm 20*c*, so that the pressure force on the closing lever 20 from the sector gear 26 is released. However, as described above, the hook 12 is prevented from rotating in the clockwise direction with respect to FIG. 10 (in the direction toward the striker releasing position) due to the engagement thereof with the ratchet 13, and the closing lever 20 which is integrated with the hook 12 via the interlocking lever 21 is also prevented from rotating in the clockwise direction (in the direction toward the draw-in releasing position) against the biasing force F4 of the extension spring 25. In other words, the fully-latched state is maintained.

Upon the opening operation switch 33A (FIG. 12) which is electrically connected to the electronic control unit 32 being turned ON in the fully-latched state (T10), the motor 27*a* is driven in the reverse direction (T11) to rotate the sector gear 26 in the counterclockwise direction from the initial position shown in FIG. 8 (T12). Thereupon, the opening lever operating piece 26*c* presses the gear contact portion 23*h*, which causes the opening lever 23 to rotate counterclockwise from the closing position shown in FIG. 10 toward the opening position against the biasing force F4 of the extension spring 25 so that the opening lever detection switch 31 is turned ON from the OFF state (T13). This counterclockwise rotation of the opening lever 23 causes the inner arc surface 23*f*1 of the interlinking-lever control groove 23*f* to press the control projection 21*c*, thus causing the interlinking lever 21 to rotate counterclockwise (toward the coupling disengaging position) about the pivot pin 22. Thereupon, this rotation of the interlinking lever 21 causes the engagement between the coupling recess 21*b* and the coupling projection 12*h* to be released, to thereby release the coupling (via the interlocking lever 21) between the hook 12 and the closing lever 20 from each other. In addition, the ratchet pressure projection 21*d* of the interlinking lever 21 that rotates in the counterclockwise direction presses the pressed piece 13*g* of the ratchet 13 to rotate the ratchet 13 in the clockwise direction from the latching position to the unlatching position against the biasing force F2 of the torsion spring 17 (T14).

This rotation of the ratchet 13 to the unlatching position causes the engagement between the rotation-restriction stepped portion 13*c* and the ratchet-engaging stepped portion 12*e*, i.e., the prevention of rotation of the hook 12, to be released, which causes the hook 12 to rotate toward the striker releasing position shown in FIG. 8 from the striker holding position shown in FIG. 10 by the biasing force F1 of the torsion spring 16. The closing lever 20, the engagement of which with the hook 12 has been released, is also rotated in the clockwise direction toward the draw-in releasing position shown in FIGS. 8 and 9 from the draw-in position shown in FIG. 10 by the biasing force F4 of the extension spring 25; in accordance with this rotation, the control projection 21*c* of the interlinking lever 21 moves in the interlinking-lever control groove 23*f* toward the lower end thereof while sliding on the inner arc surface 23*f*1. Additionally, during the time the opening lever 23 is held in the opening position, the interlinking lever 21 is prevented from rotating (rotating about the pivot pin 22) in a direction (toward the coupling position) to make the coupling recess 21*b* and the coupling projection 12*h* re-engaged with each other by the engagement between the inner arc surface 23*f*1 and the control projection 21*c*. In other words, the inner arc surface 23*f*1 functions as a guide surface which determines the path of the rotational movement of the interlinking lever 21 during the opening operation from the fully-latched state.

Upon the interlinking lever 21 moving downward by a predetermined amount of movement following the rotation of the closing lever 20 toward the draw-in releasing position, the pressure of the ratchet pressure projection 21*d* of the interlinking lever 21 against the pressed piece 13*g* of the ratchet 13 in a direction toward the unlatching position is released. However, during the time until the hook 12 reaches the striker releasing position shown in FIG. 8 from the moment the engagement between the rotation-restriction stepped portion 13*c* and the ratchet-engaging stepped portion 12*e* is released, the circular arc surface 12*g* of the second leg portion 12*d* of the hook 12 presses the circular-arc surface portion 13*d* of the ratchet 13 so that the ratchet 13 continues to be held in the unlatching position against the biasing force F2 of the torsion spring 17. More specifically, the amount of rotation of the closing lever 20 from the draw-in position (FIG. 10) to the draw-in releasing position (FIG. 9) is substantially the same as the amount of rotation of the hook 12 from the striker holding position (FIG. 10) to the draw-in commencement position (FIG. 9), and when performing the opening operation, the pressure of the interlinking lever 21 on the ratchet 13 toward the unlatching position is released at a stage before the closing lever 20 reaches the draw-in releasing position shown in FIG. 9. On the other hand, the pressure of the second leg portion 12*d* of the hook 12 on the ratchet 13 in a direction toward the unlatching position continues for a longer period of time than the pressure of the interlinking lever 21 on the ratchet 13, and it is not until the engagement between the circular arc surface 12*g* and the circular-arc surface portion 13*d* is released, upon the ratchet pressure projection 12*f* moving over the stepped portion 13*e* of the ratchet 13 after the hook 12 reaches the striker releasing position (FIG. 8), that the ratchet 13 is allowed to rotate to the latching position. Thereafter, the ratchet 13 rotates and returns to the latching position from the unlatching position by the biasing force F2 of the torsion spring 17 (T15) for the first time after the aforementioned allowance of rotation of the ratchet 13 takes place. Namely, the aforementioned signals representing a door-open state of the back door 3 that respectively indicate an OFF state of the ratchet detection switch 30 and an ON state of the opening lever detection switch 31 are not input until the hook 12 reaches the striker releasing position.

Upon the detection of the door-open state of the back door 3, the electronic control unit 32 continues to drive the motor 27*a* in the reverse direction by a predetermined overstroke amount in order to ensure a latch released state, and thereafter drives the motor 27*a* forwardly in the door closing direction (T16). This forward driving of the motor 27*a* is for returning the sector gear 26, which has been rotated counterclockwise from the initial position shown in FIG. 8 when performing the opening operation, to the initial position, and upon the sector gear detection switch 33 detecting that the sector gear 26 has returned to the initial position thereof (T17) the motor 27*a* is stopped (T18), the lock mechanism 10 returns to the door-open state of the back door 3 shown in FIG. 8.

FIG. 16 shows a process performed in the case where the opening (closure-canceling) operation is performed by an operation of the opening operation switch 33A (FIG. 12) during the time the lock mechanism 10 moves from the half-latched state shown in FIG. 9 until coming into the fully-latched state shown in FIG. 10. Operations are the same as those of the above described normal operations until when the motor 27*a* is driven forward, in response to an input of the signal representing the half-latched state (in which the ratchet detection switch 30 is ON and the opening lever detection switch 31 is OFF), to rotate the sector gear 26 clockwise with respect to FIG. 9 to thereby press and rotate the closing lever 20 toward the draw-in position (T5). At this stage, upon the opening operation switch 33A being turned ON before the lock mechanism 10 comes into the fully-latched state (T19), the electronic control unit 32 switches the driving direction of the motor 27*a* from forward to reverse (T20). Thereupon, the sector gear 26 stops pressing the closing lever 20 via the closing lever operating portion 26*d*. This causes the combination of the hook 12 and the closing lever 20 to return to a position in the half-latched state shown in FIG. 9 by the biasing force F1 of the torsion spring 16 and the biasing force F3 of the extension spring 25. Although the sector gear 26 temporarily returns to the initial position (T21), the sector gear 26 continues to be driven in the reverse direction without the motor 27*a* being stopped. Thereupon, the opening lever operating piece 26*c* of the sector gear 26 presses the gear contact portion 23*h* to rotate the opening lever 23 counterclockwise toward the opening position from the closing position against the biasing force F4 of the extension spring 25, and this operation is detected by the opening lever detection switch 31 (T22).

When the opening lever 23 rotates to the opening position in the half-latched state shown in FIG. 9, a predetermined idle running time (corresponding to the section in which the contact point of the control projection 21*c* is switched from the outer arc surface 23*f*2 to the inner arc surface 23*f*1) elapses, and thereafter, the inner arc surface 23*f*1 of the interlinking-lever control groove 23*f* presses the control projection 21*c*, which causes the interlinking lever 21 to rotate from the coupling position, in which the interlinking lever 21 is engaged with the coupling projection 12*h* of the hook 12, to the coupling disengaging position. This causes the engagement between the hook 12 and the closing lever 20 to be released, thus causing the hook 12 to solely rotate toward the striker releasing position shown in FIG. 8 from the draw-in commencement position shown in FIG. 9 by the biasing force F1 of the torsion spring 16. Upon the hook 12 reaching the striker releasing position, the pressure of the circular arc surface 12*g* of the second leg portion 12*d* against the circular-arc surface portion 13*d* is released, so that the ratchet 13 rotates from the latching position to the unlatching position, and this operation is detected by the ratchet detection switch 30 (T23). This produces a signal indicating the door-open state of the back door 3, in which the ratchet detection switch 30 is OFF and the opening lever detection switch 31 is ON. Upon input of this signal, similar to the case when normal operations are performed, the motor 27*a* is driven forward after being driven reverse continuously by a predetermined amount of overstroke (T24) to return the sector gear 26 to the initial position (T25) and subsequently the back door 3 returns to the door-open state shown in FIG. 8 by stopping the motor 27*a* (T26).

FIG. 17 shows a process performed in the case where a mechanical opening (closure-canceling) operation is performed via the emergency release handle or the key apparatus instead of the opening operation switch 33A during the time the lock mechanism 10 moves from the half-latched state shown in FIG. 9 until coming into the fully-latched state shown in FIG. 10. Operations are the same as those of the above described normal operations until when the motor 27*a* is driven forward upon detection of the signal representing the half-latched state (in which the ratchet detection switch 30 is ON and the opening lever detection switch 31 is OFF) to rotate the sector gear 26 clockwise with respect to FIG. 9 to thereby press and rotate the closing lever 20 (T5). At this stage, an operation of the key apparatus and the emergency release handle or the key apparatus (T27) causes a force pulling the first arm 23*b* upward to be applied to the opening lever 23, thus causing the opening lever 23 to rotate from the closing position to the opening position, so that the opening lever detection switch 31 is switched from the OFF state (closing position) to the ON state (opening position) (T28). This rotation of the opening lever 23 causes the inner arc surface 23*f*1 of the interlinking-lever control groove 23*f* to press the control projection 21*c* of the interlinking lever 21, thus causing the interlinking lever 21 to rotate (rotate on its axis) counterclockwise about the pivot pin 22 to thereby be disengaged from the coupling projection 12*h* of the hook 12. Accordingly, the hook 12, the engagement of which with the closing lever 20 has been released, is rotated toward the striker releasing position shown in FIG. 8 by the biasing force F1 of the torsion spring 16. Subsequently, upon the hook 12 reaching the striker releasing position, the pressure of the circular arc surface 12*g* of the second leg portion 12*d* on the circular-arc surface portion 13*d* is released, which causes the ratchet 13 to rotate from the latching position to the unlatching position, so that the ratchet detection switch 30 is turned OFF from the ON state (T29). The door-open state of the back door 3 is detected from a combination of this OFF state of the ratchet detection switch 30 and the ON state of the opening lever detection switch 31. Upon this detection of the door-open state of the back door 3, the electronic control unit 32 switches the driving direction of the motor 27*a* from forward, which is for closing, to reverse (T30), which causes the sector gear 26 to rotate toward the initial position from the position where the sector gear 26 presses the closing lever 20. Upon the sector gear detection switch 33 detecting that the sector gear 26 returns to the initial position thereof (T31), the motor 27*a* is stopped (T32); consequently, the lock mechanism 10 returns to the door-open state of the back door 3 shown in FIG. 8.

The following is a detailed explanation of how the electronic control unit (ECU) 32 transfers the operation mode thereof between the microcomputer normal power mode (FIG. 13) and the microcomputer power-saving power mode (FIG. 14).

As clearly shown by the timing charts in FIGS. 15 through 17, it can be determined whether the lock mechanism 10 is in the open state, the half-latched state and a fully-latched state by the combination of the ON/OFF states of the ratchet detection switch 30 and the open-lever detection switch 31. For example, when the ratchet detection switch 30 is OFF and the open-lever detection switch 31 is ON, the lock mechanism 10 is in the open state; when the ratchet detection switch 30 is ON and the open-lever detection switch 31 is OFF, the lock mechanism 10 is in the half-latched state; and when the ratchet detection switch 30 and the open-lever detection switch 31 are both OFF, the lock mechanism 10 is in the fully-latched state.

When the state of the lock mechanism 10 is switched (between the open state, the half-latched state and a fully-latched state), the ratchet detection switch 30 always switches the ON/OFF state thereof (T2, T6, T14 and T15 of FIG. 15; T2 and T23 of FIG. 16; and T2 and T29 of FIG. 17). Namely, the ratchet detection switch 30 operates in association with the switching of the state (the open state, the half-latched state and a fully-latched state) of the lock mechanism 10, and the rotational position of the hook 12, which rotates between the striker open position and the fully-latched position, is detected indirectly via the ratchet 13. Accordingly, the ratchet detection switch 30 can be said to be an extremely important switch which can detect the state of the lock mechanism 10 instantaneously.

Furthermore, in the illustrated embodiment, when the electronic control unit 32 is operating in the microcomputer power-saving power mode (FIG. 14), when the ratchet detection switch monitor 200 detects that the ON/OFF state of the ratchet detection switch 30 has switched or the open-operation detection switch monitor 500 detects that an opening operation request signal has been input from the opening operation switch 33A, the operation mode of the electronic control unit 32 is transferred (returned) from the microcomputer power-saving power mode (FIG. 14) to the microcomputer normal power mode (FIG. 13). Accordingly, the ratchet detection switch 30 and the opening operation switch 33A can be said as being extremely important switches for transferring (returning) the electronic control unit 32 from the microcomputer power-saving power mode to the microcomputer normal power mode.

Hence, in the illustrated embodiment, during operation of the electronic control unit 32 in the microcomputer normal power mode (FIG. 13), the ratchet detection switch 30, the open-lever detection switch 31, the sector gear detection switch 33 and the opening operation switch 33A are constantly monitored by the ratchet detection switch monitor 200, the open-lever detection switch monitor 300, the sector-gear detection switch monitor 400 and the open-operation detection switch monitor 500, respectively, at the predetermined clock frequency X(Hz).

Furthermore, when the electronic control unit 32 is operating in the microcomputer normal power mode (FIG. 13), when it is determined that the lock mechanism 10 continuously remains for a predetermined period of time (e.g., 5 seconds) at one of the open state, the half-latched state and the fully-latched state, the operation mode thereof transfers from the microcomputer normal power mode (FIG. 13) to the microcomputer power-saving power mode (FIG. 14). In other words, the electronic control unit 32 monitors the ratchet detection switch 30 and the opening operation switch 33A at the same predetermined clock frequency X(Hz) as the microcomputer normal power mode by the ratchet detection switch monitor 200 and the open-operation detection switch monitor 500. Whereas, the electronic control unit 32 either stops monitoring the open-lever detection switch 31 and the sector gear detection switch 33 at the predetermined clock frequency X(Hz) of the microcomputer normal power mode by the remaining open-lever detection switch monitor 300 and the sector-gear detection switch monitor 400, or monitors at a clock frequency x(Hz) that is lower than the predetermined clock frequency X(Hz) of the microcomputer normal power mode.

Accordingly, even in the microcomputer power-saving power mode (FIG. 14), due to the electronic control unit 32 monitoring the ratchet detection switch 30 and the opening operation switch 33A at the same predetermined clock frequency X(Hz) as the microcomputer normal power mode by the ratchet detection switch monitor 200 and the open-operation detection switch monitor 500, the opening and closing of the back door can be favorably carried out while reducing the power consumption of the electronic control unit 32.

Figure 18:
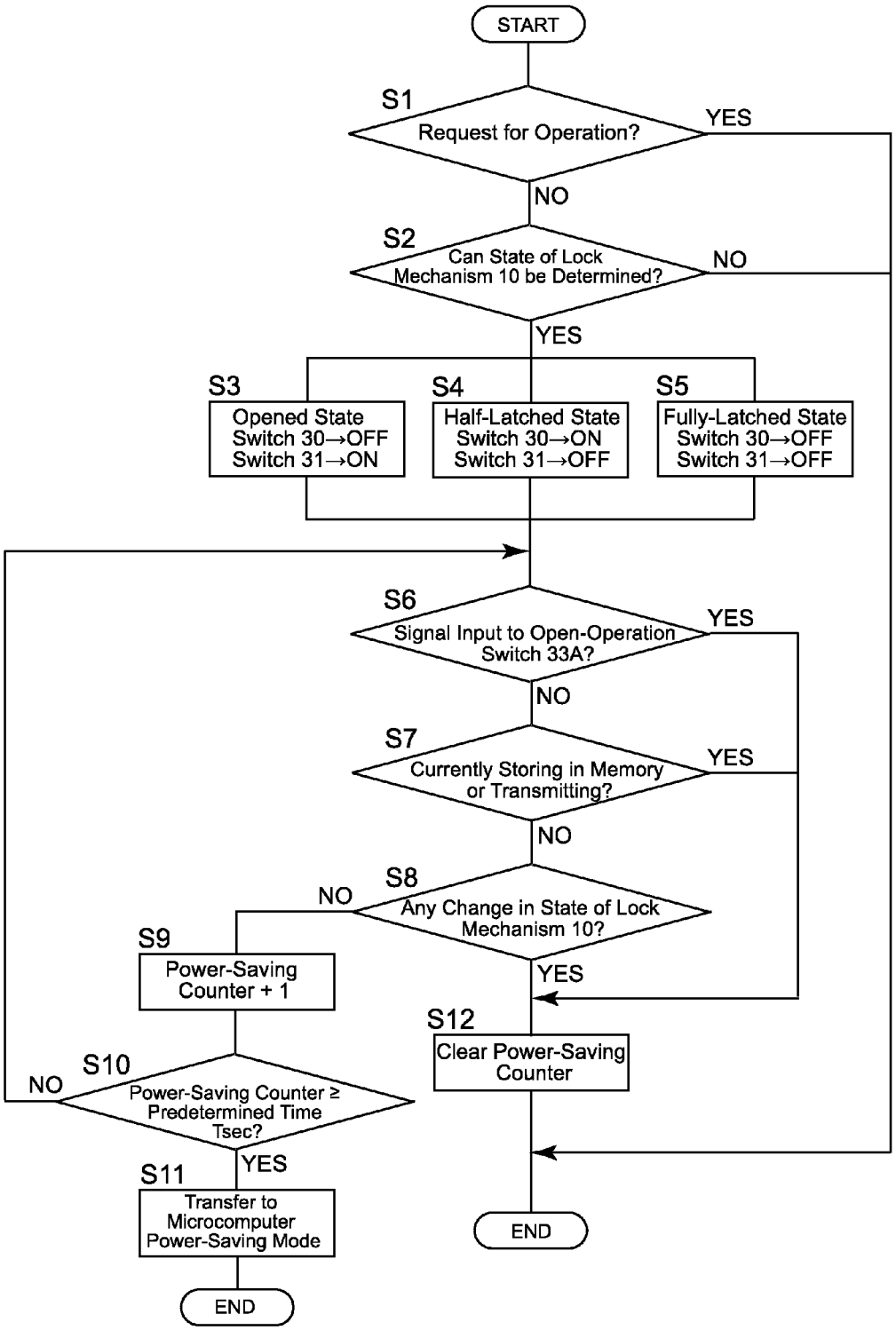
FIG. 18 is a flowchart showing operations in the microcomputer normal power mode of the electronic control unit (ECU)

The following is an explanation of the operations in the microcomputer normal power mode of the electronic control unit 32 with reference to the flowchart of FIG. 18.

First the electronic control unit 32 determines whether or not there is a request for operation of the back door 3 by determining whether or not an open-operation request has been input from the opening operation switch 33A, or whether or not the back door 3 has been manually opened or closed (S1). When the electronic control unit 32 determines that an operation of the back door 3 is requested (S1: YES), control ends with the operation mode remaining in the microcomputer normal power mode (END).

When the electronic control unit 32 determines that an operation of the back door 3 is not requested (S1:NO), it is determined whether the lock mechanism 10 remains in the open state, half-latched state or the fully-latched state by monitoring the ON/OFF states of the ratchet detection switch 30 and the open-lever detection switch 31 (S2). For example, the electronic control unit 32 determines that the lock mechanism 10 is in the open state when the ratchet detection switch 30 is OFF and the open-lever detection switch 31 is ON (S2: YES; S3), determines that the lock mechanism 10 is in the half-latched state when the ratchet detection switch 30 is ON and the open-lever detection switch 31 is OFF (S2: YES; S4), and determines that the lock mechanism 10 is in the fully-latched state when the ratchet detection switch 30 and the open-lever detection switch 31 are both OFF (S2: YES; S5). Whereas, if the electronic control unit 32 determines that the lock mechanism 10 is in neither of the open state (S3), the half-latched state (S4) nor the fully-latched state (S5) (S2:NO), control ends with the operation mode remaining in the microcomputer normal power mode (END).

When the electronic control unit 32 determines that the lock mechanism 10 remains at any one of the open state, half-latched state or fully-latched state (S2:YES; S3; S4; S5), the electronic control unit 32 determines whether or not an operation request has been input to the opening operation switch 33A (S6), whether or not data is currently being written in memory or currently being transmitted (S7), and whether or not the opening amount of the back door 3 has changed (S8), in that order. The order of the determination processes in steps S6 through S8 can be any order.

If an operation request is not input to the opening operation switch 33A (S6:NO), data is not being currently written in memory or currently being transmitted (S7:NO), and the state of the lock mechanism 10 has not changed (S8:NO), the electronic control unit 32 increments the power-saving counter by 1 (S9).

The electronic control unit 32 repeats the loop of processes from step S6 through S9 until the power-saving counter is less than a predetermined value Tsec (S10:NO), and when the power-saving counter reaches a value greater than or equal to the predetermined value Tsec (S10:YES), the operation mode thereof is transferred from the microcomputer normal power mode to the microcomputer power-saving power mode, and control ends (S11, END).

Whereas, when an operation request is input to the opening operation switch 33A (S6:YES), data is currently being written in memory or being transmitted (S7:YES), or the state of the lock mechanism 10 has changed (S8:YES), before the power-saving counter reaches the predetermined value Tsec (S10:NO), the electronic control unit 32 clears the power-saving counter to zero (S12) and control ends with the operation mode remaining in the microcomputer normal power mode (END).

Figure 19:
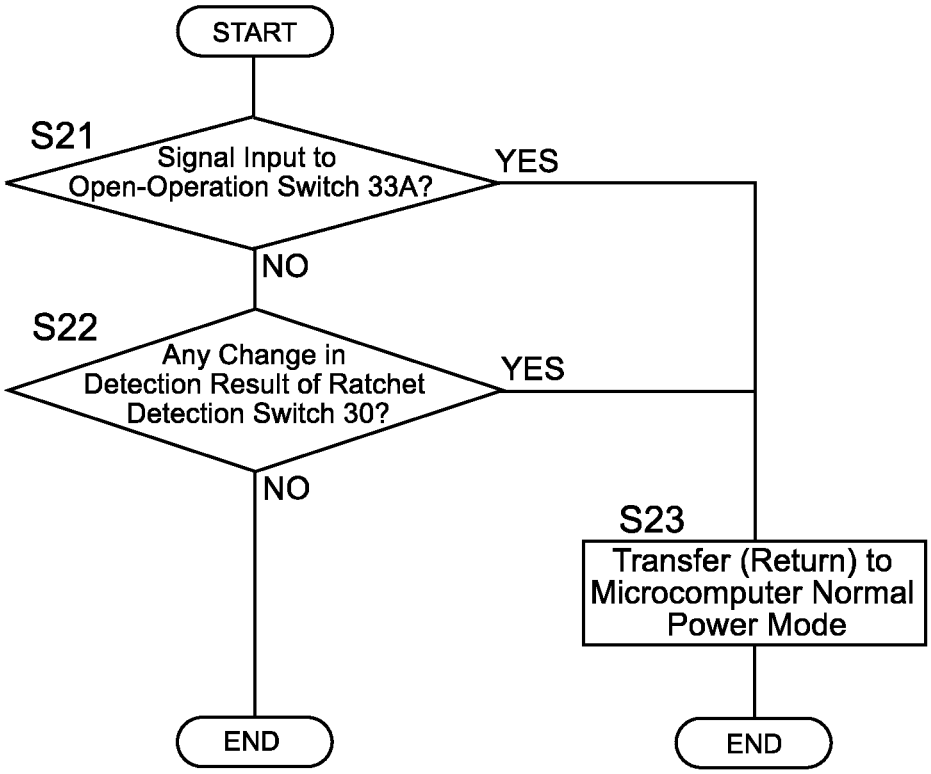
FIG. 19 is a flowchart showing operations in the microcomputer power-saving mode of the electronic control unit (ECU).

Lastly, the following is an explanation of the operations in the microcomputer power-saving mode of the electronic control unit 32 with reference to the flowchart of FIG. 19.

First the electronic control unit 32 determines whether or not an operation request has been input to the opening operation switch 33A (S21), and whether or not the detected result of the ratchet detection switch 30 has changed (S22), in that order. The order of the determination processes in step S21 and step S22 can be any order.

If an operation request is not input to the opening operation switch 33A (S21:NO) and the detected result of the ratchet detection switch 30 has not changed (S22:NO), the electronic control unit 32 ends control with the operation mode remaining in the microcomputer power-saving mode (END).

If an operation request is input to the opening operation switch 33A (S21:YES) or the detected result of the ratchet detection switch 30 has changed (S22:YES), the electronic control unit 32 transfers (returns) the operation mode thereof from the microcomputer power-saving mode to the microcomputer normal power mode, and control ends (END).

As discussed above, according to the lock device of the illustrated embodiment, when the open-state detector (the ratchet detection switch 30 and the open-lever detection switch 31) detects that the lock mechanism 10 remains in one of the open state, the half-latched state or the fully-latched state for a predetermined period of time during the microcomputer normal power mode, the electronic control unit 32 operates upon transferring from the microcomputer normal power mode to the microcomputer power-saving mode. Accordingly, the power consumption of the microcomputer including the switch monitor (the ratchet detection switch monitor 200, the open-lever detection switch monitor 300, the sector-gear detection switch monitor 400 and the open-operation detection switch monitor 500) of the electronic control unit 32 can be drastically reduced so that a battery, for supplying power to a microcomputer, can be reliably prevented from going flat.

In the illustrated embodiment, the electronic control unit 32, in the microcomputer power-saving mode, monitors the ratchet detection switch 30 and the opening operation switch 33A at the same predetermined clock frequency X(Hz) as that of the microcomputer normal power mode, whereas the monitoring of the open-lever detection switch 31 and the sector gear detection switch 33 at the predetermined clock frequency X(Hz) is either stopped or monitored at a clock frequency x(Hz) that is lower than that of the predetermined clock frequency X(Hz). However, the electronic control unit 32, in the microcomputer power-saving mode, can stop monitoring at least some of the switches of the ratchet detection switch 30, the open-lever detection switch 31, the sector gear detection switch 33 and the opening operation switch 33A at the predetermined clock frequency X(Hz) or can monitor at a clock frequency x(Hz) that is lower than that of the predetermined clock frequency X(Hz).

In the illustrated embodiment, a closure mechanism is provided which switches the state of the lock mechanism 10 between the half-latched state and the fully-latched state via motor drive. However, the lock device of the present invention can be applied to a "manual lock" type which does not have a closure device. Even in a manual lock device, since, for example, an electrical contact for half-door detection exists, a certain power-saving effect can be achieved by transferring the operation mode of the electronic control unit to the microcomputer power-saving mode.

In the illustrated embodiment, although the lock device of the present invention has been described as an embodiment applied to a door closure device for a vehicle door, the present invention is not limited thereto. The lock device of the present invention can be applied to various mechanical systems having a lock mechanism that switches between an open state, a half-latched state and a fully-latched state in accordance with an opening state of an opening-and-closing body which opens and closes an opening in a vehicle body, and an electronic control unit which operates in a microcomputer normal power mode or a microcomputer power-saving mode.

INDUSTRIAL APPLICABILITY

The lock device of the present invention is suitable for use in various kinds of device such as a closure device for a vehicle.

REFERENCE SIGNS LIST

1 Vehicle body
2 Rear opening (opening)
3 Back door (opening-and-closing body)
10 Lock mechanism
11 Base plate
11*a* Striker entry groove
11*j* Support projection 11*j*
11*k* Annular stepped portion
12 Hook
12*b* Striker holding groove
12*e* Ratchet-engaging stepped portion
12*f* Ratchet pressure projection
12*g* Circular arc surface
12*h* Coupling projection
13 Ratchet
13*c* Rotation-restriction stepped portion
13*d* Circular-arc surface portion
13*e* Stepped portion
13*f* Switch operating member
13*g* Pressed member
16 Torsion spring
17 Torsion spring
20 Closing lever
20*b* First arm
20*c* Second arm
20*d* Recess
21 Interlinking lever
21*b* Coupling recess
21*c* Control projection
21*d* Ratchet pressure projection
23 Open lever
23*b* First arm
23*c* Second arm
23*d* Handle interlinking hole
23*e* Switch operating member
23*f* Interlinking-lever control hole
23*f*1 Inner arc surface
23*f*2 Outer arc surface
25 Extension spring
26 Sector gear
26*c* Open-lever operating piece
26*d* Closing lever operating portion
27 Motor unit
27*a* Motor
27*b* Pinion
27*c* Socket
30 Ratchet detection switch (open-state detector)
31 Open-lever detection switch (open-state detector)
32 Electronic control unit
33 Sector gear detection switch
33A Opening operation switch (Open Switch)
34 Pressing member
35 36 37 Wire harness
35*a* 36*a* 37*a* Bent portion
38 Connector
39 Wire harness
39*a* Bent portion
43 Wire harness
43*a* Connector
43*b* Bent portion
100 Motor drive control instructor
200 Ratchet detection switch monitor
300 Open-lever detection switch monitor
400 Sector-gear detection switch monitor
500 Open-operation detection switch monitor
S Striker

The invention claimed is:

1. A lock mechanism comprising:

a lock mechanism which holds an opening-and-closing body, which opens and closes an opening in a vehicle body, at a position that closes said opening, said lock mechanism switching between an opening state, a half-latched state and a fully-latched state;

an electronic control unit which operates in a microcomputer normal power mode or a microcomputer power-saving mode; and an open-state detector which detects the state of said lock mechanism, wherein said electronic control unit transfers from said microcomputer normal power mode to said microcomputer power-saving mode when said open-state detector detects that said lock mechanism continuously remains at one of said opening state and said half-latched state for a predetermined period of time when operating during said microcomputer normal power mode, and wherein said electronic control unit transfers from said microcomputer power-saving mode to said microcomputer normal power mode in accordance with signals which are received before said lock mechanism changes from one state to another state thereof.

2. The lock device according to claim 1, wherein said lock mechanism if provided with a hook which is rotatable between a striker open position and a fully-latched position, and wherein said open-state detector detects the state of said lock mechanism by the rotational position of said hook.

3. The lock device according to claim 1, further comprising a closure mechanism which switches the state of said lock mechanism from the half-latched state to the fully-latched state via driving of a motor, wherein said lock mechanism is provided with a ratchet which rotates between a latching position and an unlatching position, a sector gear which rotates in accordance with forward and reverse rotation of said motor, an open lever which rotates between an open position and a closed position in association with the rotation of said sector gear, a ratchet detection switch which detects the rotational position of said ratchet, a sector gear detection switch which detects that said sector gear has returned to an initial position after the state of said lock mechanism has changed, an open-lever detection switch which detects a rotational position of said open lever, and an opening operation switch which inputs an open-operation request via said closure mechanism, wherein said electronic control unit, in said microcomputer normal power mode, monitors each of said ratchet detection switch, said sector gear detection switch, said open-lever detection switch and said opening operation switch at a predetermined clock frequency, and wherein, in said microcomputer normal power mode, when said open-state detector detects that said lock mechanism continuously remains at said open state or said half-latched state for a predetermined period of time, the monitoring of said ratchet detection switch is continued at said predetermined clock frequency while the monitoring of at least one of said sector gear detection switch, said open-lever detection switch and said opening operation switch at said predetermined clock frequency is stopped or continues monitoring at a clock frequency that is lower than said predetermined clock frequency.

4. The lock device according to claim 3, wherein in said microcomputer power-saving mode, when said ratchet detection switch detects that the rotational position of said ratchet has changed or when said open-operation request is input to said opening operation switch, said electronic control unit transfers from said microcomputer power-saving mode to said microcomputer normal power mode.

5. The lock device according to claim 1, further comprising a closure mechanism which switches the state of said lock mechanism from the half-latched state to the fully-latched state via driving of a motor, wherein said lock mechanism is provided with a ratchet which rotates between a latching position and an unlatching position, a sector gear which rotates in accordance with forward and reverse rotation of said motor, an open lever which rotates between an open position and a closed position in association with the rotation of said sector gear, a ratchet detection switch which detects the rotational position of said ratchet, a sector gear detection switch which detects that said sector gear has returned to an initial position after the state of said lock mechanism has changed, an open-lever detection switch which detects a rotational position of said open lever, and an opening operation switch which inputs an open-operation request via said closure mechanism, wherein said electronic control unit, in said microcomputer normal power mode, monitors each of said ratchet detection switch, said sector gear detection switch, said open-lever detection switch and said opening operation switch at a predetermined clock frequency, and wherein, in said microcomputer normal power mode, when said open-state detector detects that said lock mechanism continuously remains at said fully-latched state for a predetermined period of time, the monitoring of at least one of said ratchet detection switch, said sector gear detection switch, said open-lever detection switch and said opening operation switch at said predetermined clock frequency is stopped or continues monitoring at a clock frequency that is lower than said predetermined clock frequency.

6. The lock device according to claim 5, wherein in said microcomputer power-saving mode, when said ratchet detection switch detects that the rotational position of said ratchet has changed or when said open-operation request is input to said opening operation switch, said electronic control unit transfers from said microcomputer power-saving mode to said microcomputer normal power mode.

7. The lock device according to claim 1, wherein said electronic control unit transfers from said microcomputer normal power mode to said microcomputer power-saving mode when said open-state detector detects that said lock mechanism continuously remains at said opening state for a predetermined time, and wherein said electronic control unit transfers from said microcomputer normal power mode to said microcomputer power-saving mode when said open-state detector detects that said lock mechanism continuously remains at said half-latched state for a predetermined time.

8. A lock mechanism comprising:

a lock mechanism which holds an opening-and-closing body, which opens and closes an opening in a vehicle body, at a position that closes said opening, said lock mechanism switching between an opening state, a half-latched state and a fully-latched state;

an electronic control unit which operates in a microcomputer normal power mode or a microcomputer power-saving mode;

an open-state detector which detects the state of said lock mechanism, wherein said electronic control unit transfers from said microcomputer normal power mode to said microcomputer power-saving mode when said open-state detector detects that said lock mechanism continuously remains at one of said opening state, said half-latched state and said fully-latched state for a predetermined period of time when operating during said microcomputer normal power mode; and a closure mechanism which switches the state of said lock mechanism from the half-latched state to the fully-latched state via driving of a motor, wherein said lock mechanism is provided with a ratchet which rotates between a latching position and an unlatching position, a sector gear which rotates in accordance with forward and reverse rotation of said motor, an open lever which rotates between an open position and a closed position in association with the rotation of said sector gear, a ratchet detection switch which detects the rotational position of said ratchet, a sector gear detection switch which detects that said sector gear has returned to an initial position after the state of said lock mechanism has changed, an open-lever detection switch which detects a rotational position of said open lever, and an opening operation switch which inputs an open-operation request via said closure mechanism, wherein said electronic control unit, in said microcomputer normal power mode, monitors each of said ratchet detection switch, said sector gear detection switch, said open-lever detection switch and said opening operation switch at a predetermined clock frequency, and wherein, in said microcomputer normal power mode, when said open-state detector detects that said lock mechanism continuously remains at said open state or said half-latched state for a predetermined period of time, the monitoring of said ratchet detection switch is continued at said predetermined clock frequency while the monitoring of at least one of said sector gear detection switch, said open-lever detection switch and said opening operation switch at said predetermined clock frequency is stopped or continues monitoring at a clock frequency that is lower than said predetermined clock frequency.

9. The lock device according to claim 8, wherein in said microcomputer power-saving mode, when said ratchet detection switch detects that the rotational position of said ratchet has changed or when said open-operation request is input to said opening operation switch, said electronic control unit transfers from said microcomputer power-saving mode to said microcomputer normal power mode.

10. A lock mechanism comprising:

a lock mechanism which holds an opening-and-closing body, which opens and closes an opening in a vehicle body, at a position that closes said opening, said lock mechanism switching between an opening state, a half-latched state and a fully-latched state;

an electronic control unit which operates in a microcomputer normal power mode or a microcomputer power-saving mode;

an open-state detector which detects the state of said lock mechanism, wherein said electronic control unit transfers from said microcomputer normal power mode to said microcomputer power-saving mode when said open-state detector detects that said lock mechanism continuously remains at one of said opening state, said half-latched state and said fully-latched state for a predetermined period of time when operating during said microcomputer normal power mode; and a closure mechanism which switches the state of said lock mechanism from the half-latched state to the fully-latched state via driving of a motor, wherein said lock mechanism is provided with a ratchet which rotates between a latching position and an unlatching position, a sector gear which rotates in accordance with forward and reverse rotation of said motor, an open lever which rotates between an open position and a closed position in association with the rotation of said sector gear, a ratchet detection switch which detects the rotational position of said ratchet, a sector gear detection switch which detects that said sector gear has returned to an initial position after the state of said lock mechanism has changed, an open-lever detection switch which detects a rotational position of said open lever, and an opening operation switch which inputs an open-operation request via said closure mechanism, wherein said electronic control unit, in said microcomputer normal power mode, monitors each of said ratchet detection switch, said sector gear detection switch, said open-lever detection switch and said opening operation switch at a predetermined clock frequency, and wherein, in said microcomputer normal power mode, when said open-state detector detects that said lock mechanism continuously remains at said fully-latched state for a predetermined period of time, the monitoring of at least one of said ratchet detection switch, said sector gear detection switch, said open-lever detection switch and said opening operation switch at said predetermined clock frequency is stopped or continues monitoring at a clock frequency that is lower than said predetermined clock frequency.

11. The lock device according to claim 10, wherein in said microcomputer power-saving mode, when said ratchet detection switch detects that the rotational position of said ratchet has changed or when said open-operation request is input to said opening operation switch, said electronic control unit transfers from said microcomputer power-saving mode to said microcomputer normal power mode.

* * * * *